US011400713B2

(12) United States Patent
Okui

(10) Patent No.: US 11,400,713 B2
(45) Date of Patent: Aug. 2, 2022

(54) LIQUID EJECTING HEAD AND LIQUID EJECTING APPARATUS

(71) Applicant: SEIKO EPSON CORPORATION, Tokyo (JP)

(72) Inventor: Hiroaki Okui, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/036,146

(22) Filed: Sep. 29, 2020

(65) Prior Publication Data

US 2021/0094297 A1 Apr. 1, 2021

(30) Foreign Application Priority Data

Sep. 30, 2019 (JP) ..... JP2019-178211

(51) Int. Cl.
*B41J 2/14* (2006.01)
*B41J 2/045* (2006.01)

(52) U.S. Cl.
CPC ..... *B41J 2/14274* (2013.01); *B41J 2/04541* (2013.01); *B41J 2/04581* (2013.01)

(58) Field of Classification Search
CPC ..... B41J 2/14233; B41J 2/14274
See application file for complete search history.

(56) References Cited

U.S. PATENT DOCUMENTS 6,336,717 B1 * 1/2002 Shimada ..... B41J 2/14233 347/71
2016/0067967 A1 3/2016 Naganuma et al.

FOREIGN PATENT DOCUMENTS

JP 2016-058467 4/2016

* cited by examiner

*Primary Examiner* — Lam S Nguyen
(74) *Attorney, Agent, or Firm* — Workman Nydegger

(57) ABSTRACT

A width in a second direction of the first portion disposed in a position corresponding to the first piezoelectric body in the third electrode which intersects with the first direction is a first width. A width in a second direction of the second portion in the third electrode disposed in a position corresponding to the second piezoelectric body is a second width. A width in the second direction of the third portion in the third electrode disposed in a position between the first piezoelectric body and the second piezoelectric body in the first direction is a third width which is smaller than the first width and the second width.

12 Claims, 20 Drawing Sheets

LIQUID EJECTING HEAD AND LIQUID EJECTING APPARATUS

The present application is based on, and claims priority from JP Application Serial Number 2019-178211, filed Sep. 30, 2019, the disclosure of which is hereby incorporated by reference herein in its entirety.

BACKGROUND

1. Technical Field

The present disclosure relates to a liquid ejecting head.

2. Related Art

In general, recording heads including a nozzle plate, pressure chambers, a vibration plate, and piezoelectric element bodies have been used (refer to JP-A-2016-58467). When the piezoelectric element bodies are deformed by bending, the vibration plate is displaced and a pressure change occurs in the pressure chamber. As a result, ink is ejected from nozzles formed on the nozzle plate. The recording head includes a plurality of combinations of a nozzle and a pressure chamber corresponding to the nozzle. In the nozzle plate of the recording head, the plurality of nozzles are aligned as a line. The pressure chambers have an elongated shape in a direction vertical to a direction in which the nozzles are aligned.

Each of the piezoelectric element bodies includes lower electrode layers, a piezoelectric layer, and an upper electrode layer. The lower electrode layers are independently disposed for individual pressure chambers. The lower electrode layers have an elongated shape in a longitudinal direction of the pressure chambers. A width of the lower electrode layers is smaller than that of the pressure chambers. The upper electrode layer is continuously disposed over the plurality of pressure chambers. The upper electrode layer functions as a common electrode which is common to the plurality of pressure chambers. When a voltage is applied to the lower electrode layers and the upper electrode layer, distortion occurs in the piezoelectric layer positioned between the lower electrode layers and the upper electrode layer. As a result, the piezoelectric element bodies are distorted and deformed and ink in the pressure chambers is ejected from the nozzles. When voltage is selectively applied to the plurality of lower electrode layers, the ink is selectively ejected from the plurality of pressure chambers through the corresponding nozzles.

According to the recording head described above, when ink is ejected from one of the plurality of nozzles arranged as a line, only one of the lower electrode layers corresponding to a pressure chamber of the nozzle which ejects ink is turned on. Potential differences between the lower electrode layers which are turned on and the upper electrode layer which is continuously disposed over the plurality of pressure chambers cause distortion on the piezoelectric layer positioned between the lower electrode layers and the upper electrode layer. In this case, a potential which is different from that of the lower electrode layer which is turned on is applied to a portion of the upper electrode layer which faces the lower electrode layer which is turned on through the entire upper electrode layer continuously disposed over the plurality of pressure chambers. Therefore, differences among potential differences between the electrodes in various positions on the lower electrode layer in the longitudinal direction are small.

On the other hand, when the ink is ejected from all the plurality of nozzles arranged in a line, all the plurality of lower electrode layers are turned on. Potential differences between the lower electrode layers which are turned on and the upper electrode layer which is continuously disposed over the plurality of pressure chambers cause distortion on the piezoelectric layer positioned between the lower electrode layers and the upper electrode layer. In this case, in the upper electrode layer, potentials are substantially applied from opposite ends of individual elongated portions which face the corresponding lower electrode layers. Therefore, in one of the elongated portions of the upper electrode layer, potentials in portions in the vicinity of ends of the lower electrode layer in the longitudinal direction and a potential in a portion in the vicinity of a center of the lower electrode layer are different from each other due to resistance of the upper electrode layer. As a result, differences between potential differences between the electrodes in the various positions on the lower electrode layer in the longitudinal direction are large.

Therefore, potential differences between the two electrodes in positions of a pressure chamber in the longitudinal direction obtained when ink is ejected from one of the nozzles are different from potential differences between the two electrodes in the positions of the pressure changer in the longitudinal direction obtained when ink is ejected from all the plurality of nozzles. Consequently, an amount of ink and a shape of ink droplets ejected from a certain one of the nozzles may be different between the case where the ink is ejected from the certain nozzle and a case where the ink is ejected from all of the nozzles including the certain nozzle. Although the extreme case is described as an example hereinabove, a similar problem arises when the number of nozzles ejecting ink droplets and positions of nozzles ejecting ink droplets in the nozzle line are different.

SUMMARY

According to an aspect of the present disclosure, a liquid ejecting head ejecting liquid includes a first piezoelectric body, a second piezoelectric body arranged in a position different from the first piezoelectric body in a first direction, a first electrode configured to be electrically coupled to the first piezoelectric body and not to be electrically coupled to the second piezoelectric body, a second electrode configured to be electrically coupled to the second piezoelectric body and not to be electrically coupled to the first piezoelectric body, and a third electrode configured to be electrically coupled to both the first piezoelectric body and the second piezoelectric body. A width in a second direction of the first portion disposed in a position corresponding to the first piezoelectric body in the third electrode which intersects with the first direction is a first width. A width in a second direction of the second portion in the third electrode disposed in a position corresponding to the second piezoelectric body is a second width. A width in the second direction of the third portion in the third electrode disposed in a position between the first piezoelectric body and the second piezoelectric body in the first direction is a third width which is smaller than the first width and the second width.

DESCRIPTION OF EXEMPLARY EMBODIMENTS

A. First Embodiment

A1. Configurations of Liquid Ejecting Apparatus and Liquid Ejecting Head

Figure 1:
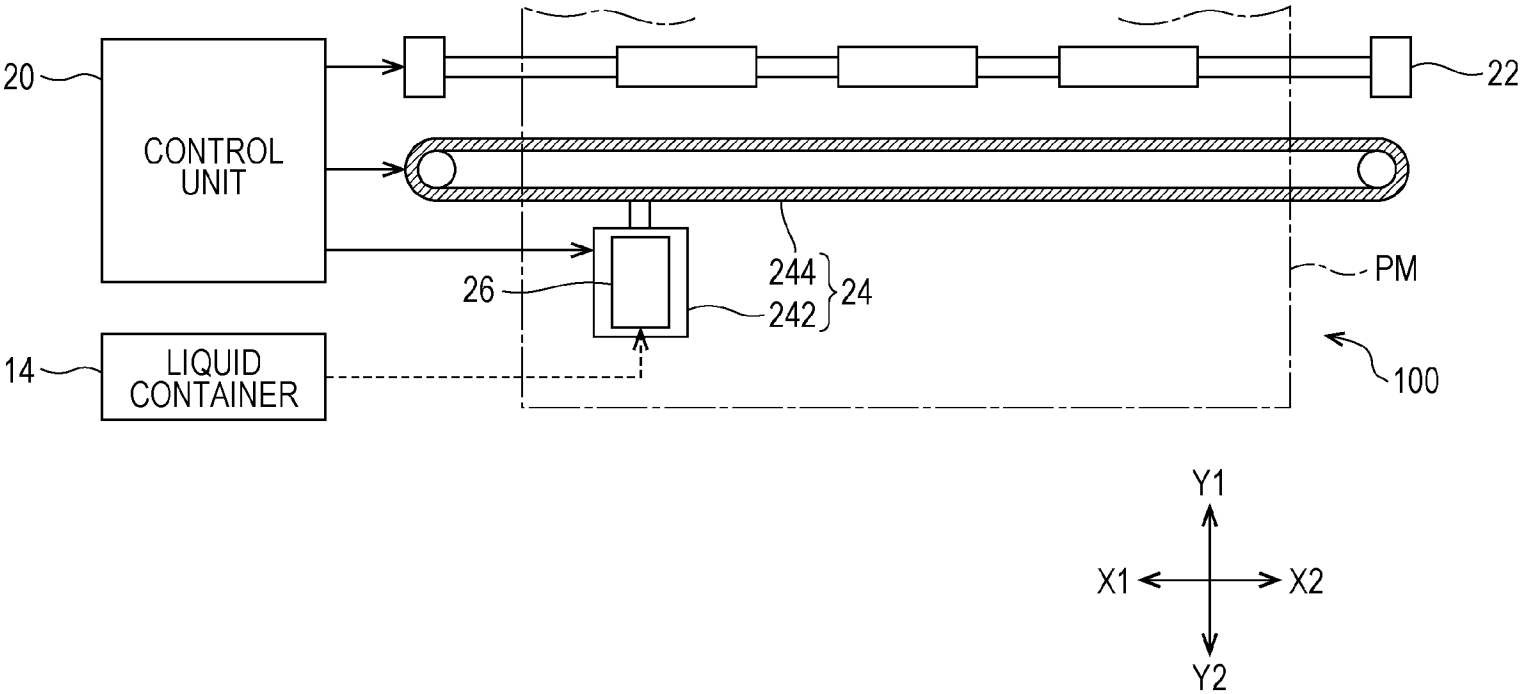
FIG. 1 is a diagram illustrating a liquid ejecting apparatus according to a first embodiment.

FIG. 1 is a diagram illustrating a liquid ejecting apparatus 100 according to a first embodiment. The liquid ejecting apparatus 100 is an ink jet printing apparatus ejecting ink which is liquid to a medium PM. A liquid container 14 storing ink may be attached to the liquid ejecting apparatus 100 and the medium PM may be set to the liquid ejecting apparatus 100. The liquid ejecting apparatus 100 may eject ink included in the liquid container 14 to the medium PM. The liquid ejecting apparatus 100 includes a control unit 20, a transport mechanism 22, a movement mechanism 24, and a liquid ejecting head 26.

The liquid ejecting head 26 includes a plurality of nozzles Nz. The liquid ejecting head 26 ejects liquid ink supplied from the liquid container 14 from the plurality of nozzles Nz. The ink ejected from the nozzles Nz are landed on the medium PM disposed in a predetermined position. A configuration of the liquid ejecting head 26 will be described in detail hereinafter.

The movement mechanism 24 includes an endless belt 244 and a carriage 242 which is fixed on the belt 244 and which may hold a liquid ejecting head 26. When the movement mechanism 24 causes the endless belt 244 to bi-directionally rotate, the liquid ejecting head 26 may reciprocate in an X direction. In FIG. 1, an X direction is indicated by two arrow marks X1 and X2 which indicate opposite directions.

The transport mechanism 22 transports the medium PM in a Y direction while the movement mechanism 24 moves the liquid ejecting head 26 a plurality of times. The Y direction is orthogonal to the X direction. As a result, an image is formed on the medium PM by the ink ejected to a virtual plane formed by the X and Y directions. In FIG. 1, the Y direction is indicated by two arrow marks Y1 and Y2 which indicate opposite directions. The medium PM is transported in a direction indicated by the arrow mark Y2.

Although not illustrated in FIG. 1, a direction orthogonal to the X and Y directions is determined as a Z direction. The liquid ejecting head 26 ejects ink in the Z direction while being transported in the X direction. Although not illustrated in FIG. 1, in the other drawings, in the Z direction, a direction in which the ink is ejected from the liquid ejecting head 26 is indicated by an arrow mark Z1 and an opposite direction is indicated by an arrow mark Z2.

The control unit 20 controls an operation of ejecting ink from the liquid ejecting head 26. The control unit 20 controls the transport mechanism 22, the movement mechanism 24, and the liquid ejecting head 26 so as to form an image on the medium PM.

Figure 2:
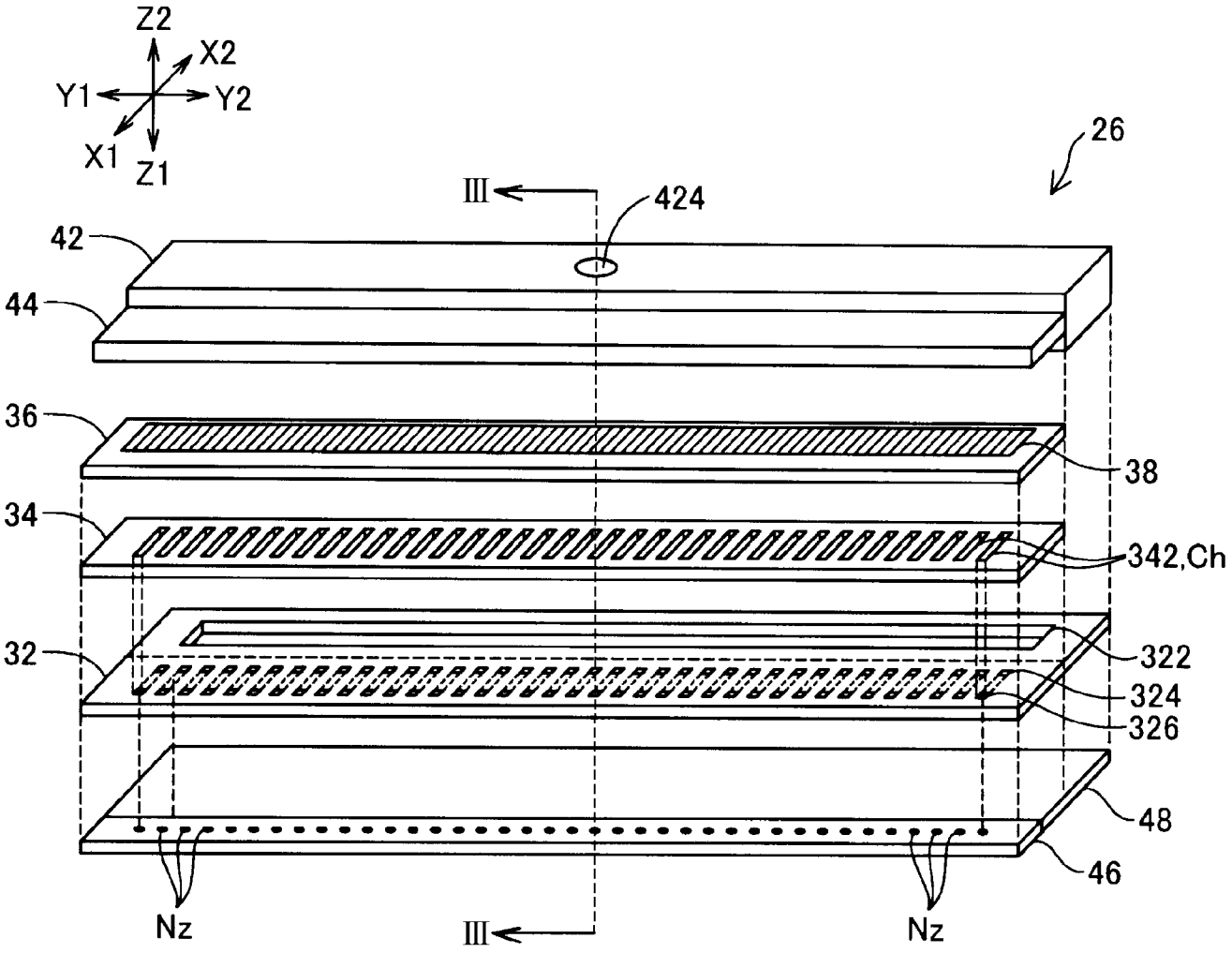
FIG. 2 is an exploded perspective view of a liquid ejecting head.

FIG. 2 is an exploded perspective view of the liquid ejecting head 26. The liquid ejecting head 26 includes a flow path substrate 32, a pressure chamber substrate 34, a vibration plate 36, piezoelectric elements 38, a case section 42, a sealing body 44, a nozzle plate 46, and a vibration absorber 48.

The flow path substrate 32 is a plate-like member having a substantially rectangle shape in appearance. The flow path substrate 32 includes an opening section 322, supply flow paths 324, communication flow paths 326, and relay flow paths 328 which function as part of an ink flow path included in the liquid ejecting head 26. Note that the relay flow paths 328 are disposed on a surface of the flow path substrate 32 on the Z1 direction side, and therefore, is not illustrated in FIG. 2.

The opening section 322 is a through hole extending in the Z direction in the flow path substrate 32. The ink ejected from all the nozzles Nz included in the liquid ejecting head 26 passes the opening section 322.

The communication flow paths 326 are through holes extending in the Z direction in the flow path substrate 32. The flow path substrate 32 includes the plurality of communication flow paths 326. The plurality of communication flow paths 326 are arranged in the Y direction on an X1 direction side relative to the opening section 322. Each of the communication flow paths 326 is coupled to a corresponding one of the plurality of nozzles Nz included in the liquid ejecting head 26. The number of communication flow paths 326 matches the number of nozzles Nz included in the liquid ejecting head 26. The ink ejected from the nozzles Nz included in the liquid ejecting head 26 passes the corresponding communication flow paths 326.

The supply flow paths 324 are through holes extending in the Z direction in the flow path substrate 32. The flow path substrate 32 includes the plurality of supply flow paths 324. Each of the supply flow paths 324 is coupled to a corresponding one of the plurality of nozzles Nz included in the liquid ejecting head 26 through a corresponding one of pressure chambers Ch described below and the communication flow paths 326. The number of supply flow paths 324 matches the number of nozzles Nz included in the liquid ejecting head 26. Each of the supply flow paths 324 is disposed between the common opening section 322 and a corresponding one of the communication flow paths 326 coupled to the supply flow paths 324. The ink ejected from the nozzles Nz included in the liquid ejecting head 26 passes the supply flow paths 324.

The relay flow path 328 is a recessed portion disposed on a surface of the flow path substrate 32 on a Z1 side, although not illustrated in FIG. 2. The relay flow path 328 is used to couple the opening section 322 to the plurality of supply flow paths 324 on the surface of the flow path substrate 32 on the Z1 side. The ink ejected from the nozzles Nz included in the liquid ejecting head 26 passes the relay flow path 328.

The pressure chamber substrate 34 is a plate-like member having a substantially rectangle shape. The pressure chamber substrate 34 is formed of silicon. The pressure chamber substrate 34 is disposed on a Z2 side relative to the flow path substrate 32. More specifically, the pressure chamber substrate 34 is a partial region of the flow path substrate 32 and is disposed such that the pressure chamber substrate 34 covers a region of the supply flow paths 324 and the communication flow paths 326. The pressure chamber substrate 34 has a plurality of opening sections 342.

The opening sections 342 are a plurality of through holes extending in the Z direction in the pressure chamber substrate 34. The opening sections 342 are arranged in positions in which the opening sections 342 overlap with corresponding pairs of the communication flow path 326 and the supply flow path 324 arranged in parallel in the X direction in the flow path substrate 32. The opening sections 342 are coupled to the corresponding pairs of the communication flow path 326 and the supply flow path 324. The number of opening sections 342 matches the number of nozzles Nz included in the liquid ejecting head 26. The opening sections 342 accommodate ink and function as the pressure chambers Ch applying pressure to the ink included in the flow paths in the liquid ejecting head 26.

The vibration plate 36 is a plate-like member having an outer shape corresponding to that of the pressure chamber substrate 34. The vibration plate 36 is disposed on the Z2 side relative to the pressure chamber substrate 34. The vibration plate 36 is disposed such that an outer shape of the vibration plate 36 matches an outer shape of the pressure chamber substrate 34 when being projected in the Z direction. The vibration plate 36 functions as an inner wall which covers the opening sections 342 on the Z2 side. The vibration plate 36 may be elastically deformed by the piezoelectric elements 38.

The piezoelectric elements 38 are disposed on the Z2 side relative to the vibration plate 36. Specifically, one piezoelectric element 38 is disposed in a position overlapping with one opening section 342 of the pressure chamber substrate 34 with the vibration plate 36 therebetween. The piezoelectric elements 38 are coupled to the vibration plate 36 through an adhesion layer, not illustrated. The number of piezoelectric elements 38 matches the number of nozzles Nz included in the liquid ejecting head 26. When receiving voltage through a wiring substrate 50, the individual piezoelectric elements 38 are deformed so as to deform the vibration plate 36 which constitutes the inner wall of the opening sections 342 (that is, the pressure chambers Ch). Consequently, the pressure chambers Ch are deformed and pressure is applied to the ink included in the pressure chambers Ch. Note that the wiring substrate 50 is omitted in FIG. 2 for facilitating understanding of the technique.

The sealing body 44 is disposed on the Z2 side relative to the vibration plate 36 and the piezoelectric elements 38. Specifically, the sealing body 44 is a partial region of the vibration plate 36 and is disposed such that the sealing body 44 covers a region of the piezoelectric elements 38. The sealing body 44 has one recessed portion on a surface on the Z1 side. The plurality of piezoelectric elements 38 disposed on the vibration plate 36 are accommodated in the recessed portion. The individual piezoelectric elements 38 may be deformed in the recessed portion of the sealing body 44 when receiving voltage. The sealing body 44 has a function of protecting the piezoelectric elements 38 and a function of mechanically enhancing the pressure chamber substrate 34 and the vibration plate 36.

The case section 42 is disposed on the Z2 side relative to the flow path substrate 32. Specifically, the case section 42 is a partial region of the flow path substrate 32 covering a region of the opening section 322. The case section 42 is disposed on an X2 side relative to the sealing body 44, the vibration plate 36, and the pressure chamber substrate 34. The case section 42 includes an accommodation section 422 and an inlet 424.

The accommodation section 422 is a recessed portion opening on the Z1 side. The accommodation section 422 is disposed inside the case section 42 and a surface on the Z1 side, and therefore, is not illustrated in FIG. 2. The accommodation section 422 overlaps with the opening section 322 of the flow path substrate 32 when being projected in the Z direction. The accommodation section 422 is coupled to the opening section 322.

The inlet 424 is a through hole extending in the Z direction and is coupled to the accommodation section 422. The inlet 424 is disposed in a substantially center in the X and Y directions on a surface of the case section 42 on the Z2 side.

The nozzle plate 46 is disposed on the Z1 side relative to the flow path substrate 32. Specifically, the nozzle plate 46 is a partial region of the flow path substrate 32 and covers a region of the communication flow paths 326. The nozzle plate 46 includes the plurality of nozzles Nz. The nozzles Nz are disposed in positions overlapping with the corresponding communication flow paths 326 of the flow path substrate 32. The nozzles Nz are coupled to the corresponding communication flow paths 326. The nozzles Nz eject ink accommodated in the pressure chambers Ch.

The vibration absorber 48 is disposed on the Z2 side relative to the flow path substrate 32. Specifically, the vibration absorber 48 is a partial region of the flow path substrate 32 and covers regions of the opening section 322, the relay flow path 328 (not illustrated in FIG. 2), and the supply flow paths 324. The vibration absorber 48 functions as an inner wall sealing the opening section 322, the relay flow path 328, and the supply flow paths 324 on the Z1 side. The vibration absorber 48 is elastically deformed in accordance with pressure of ink included in the opening section 322, the relay flow path 328, and the supply flow paths 324 so as to reduce pressure change.

Figure 3:
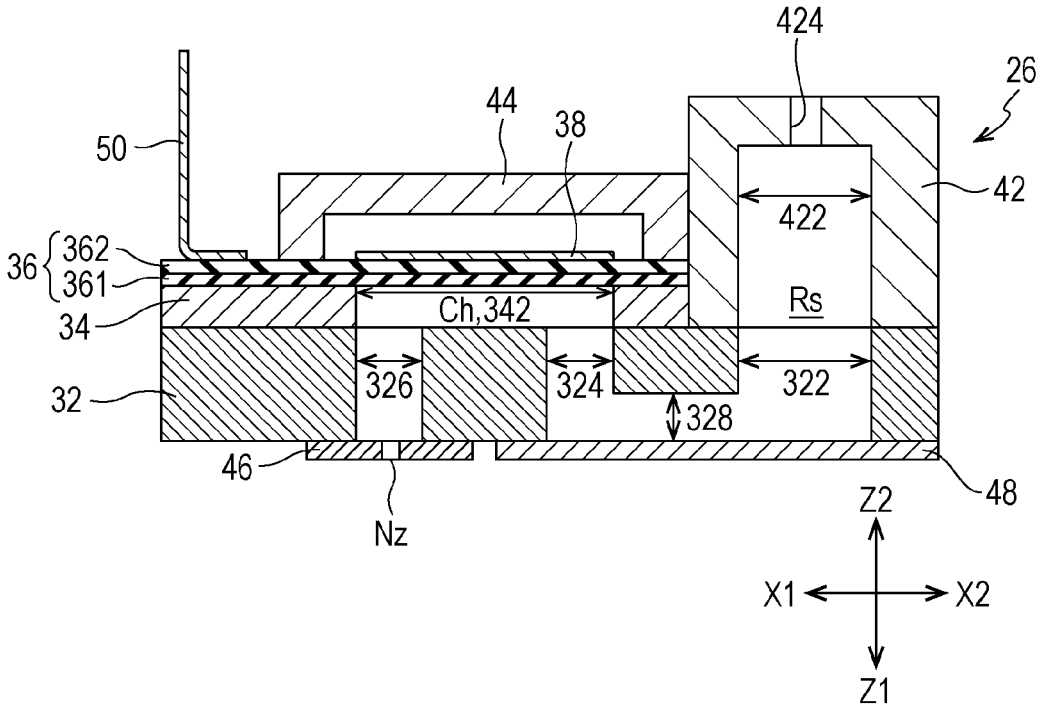
FIG. 3 is a cross-sectional view schematically illustrating a configuration of a liquid ejecting head taken along a line III to III of FIG. 2.

FIG. 3 is a diagram schematically illustrating a configuration of the liquid ejecting head 26 in the cross-sectional view of FIG. 2 taken along a line III to III. Note that FIG. 3 is a cross section of the liquid ejecting head 26 in an XZ plane passing the inlet 424 of the case section 42, one of the opening sections 342 of the pressure chamber substrate 34 (one of the pressure chambers Ch), one of the supply flow paths 324 and one of the communication flow paths 326 of the flow path substrate 32, and the like. Note that, in FIG. 3, the wiring substrate 50 omitted in FIG. 2 is illustrated.

The wiring substrate 50 is a circuit substrate including a plurality of lines to be used to electrically couple the control unit 20 (refer to FIG. 1), a power source circuit (not illustrated in FIGS. 1 to 3), and the liquid ejecting head 26. A driving signal for driving the piezoelectric elements 38 is supplied from the wiring substrate 50 to the individual piezoelectric elements 38. As the wiring substrate 50, a substrate having flexibility, such as a flexible printed circuit (FPC) may be employed, for example. Note that a flexible flat cable (FFC) may be disposed instead of the wiring substrate 50.

The vibration plate 36 includes an elastic layer 361 disposed near the pressure chambers Ch and an insulating layer 362 disposed near the piezoelectric elements 38. The elastic layer 361 is an elastic film formed of elastic material, such as silicon oxide ($SiO_2$). The insulating layer 362 is an insulating film formed of insulating material, such as zirconium oxide ($ZrO_2$).

The ink supplied to the liquid ejecting head 26 is guided from the inlet 424 to the accommodation section 422 and guided to the pressure chambers Ch (the opening sections 342) through the opening section 322, the relay flow path 328, and the supply flow paths 324. Note that a space formed by the accommodation section 422 and the opening section 322 is also referred to as a liquid storing chamber Rs. The liquid storing chamber Rs stores the ink supplied from the inlet 424 to the nozzles Nz of the liquid ejecting head 26.

One supply flow path 324, one pressure chamber Ch, one piezoelectric element 38, and one communication flow path 326 are disposed for one nozzle Nz. The ink supplied from the supply flow paths 324 to the pressure chambers Ch is pressed through the vibration plate 36 by the piezoelectric elements 38 which have received voltage. Then the ink included in the pressure chambers Ch is ejected from the nozzles Nz through the communication flow paths 326. The ink included in the pressure chambers Ch is ejected out of the liquid ejecting head 26, and thereafter, ink is newly supplied from the inlet 424 to the liquid storing chamber Rs (the accommodation section 422 and the opening section 322) when the vibration plate 36 returns to have a flat plate shape.

Figure 4:
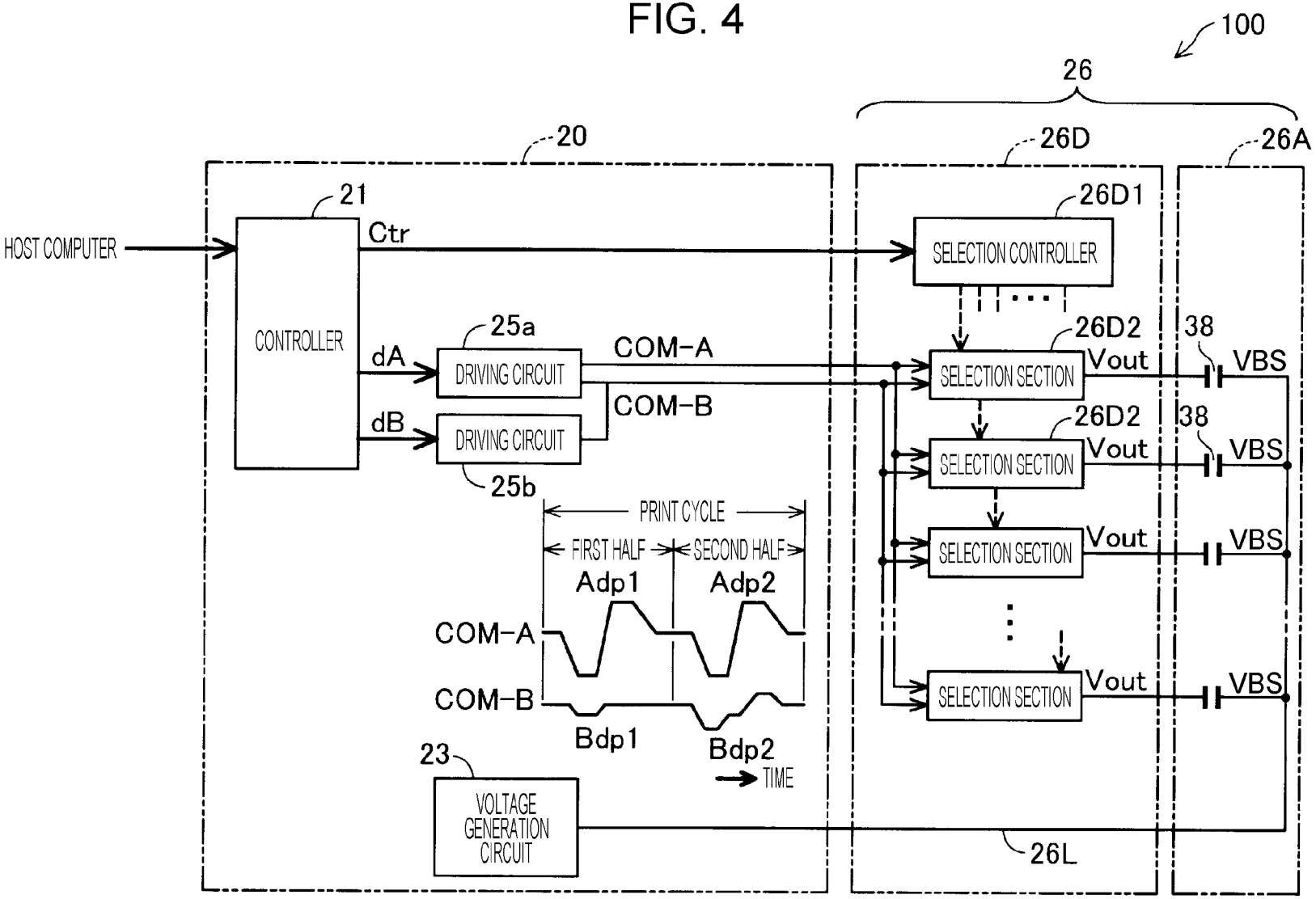
FIG. 4 is a block diagram illustrating an electric configuration of the liquid ejecting apparatus.

FIG. 4 is a block diagram illustrating an electric configuration of the liquid ejecting apparatus 100. The control unit 20 supplies a control signal Ctr, driving signals COM-A and COM-B, and a holding signal of a voltage VBS to the liquid ejecting head 26. The liquid ejecting head 26 drives the piezoelectric elements 38 in accordance with the control signal Ctr, the driving signals COM-A and COM-B, and the voltage VBS supplied from the control unit 20 so as to eject the ink from the nozzles Nz (refer to FIG. 3).

The control unit 20 includes a controller 21, driving circuits 25*a* and 25*b*, and a voltage generation circuit 23. The controller 21 is a microcomputer including a central processing unit (CPU), a random access memory (RAM), and a read only memory (ROM). The controller 21 may output various control programs and the like for controlling the sections included in the liquid ejecting apparatus 100 based on image data by executing a predetermined program using the CPU.

The controller 21 controls the movement mechanism 24 and the transport mechanism 22 (refer to FIG. 1). The controller 21 supplies the various control signals Ctr to the liquid ejecting head 26 in synchronization with control on the movement mechanism 24 and the transport mechanism 22. The control signal Ctr includes print data specifying an amount of ink to be ejected from the nozzles Nz, a clock signal to be used for transfer of print data, and a timing signal specifying a print cycle or the like. The controller 21 repeatedly supplies digital data dA to a driving circuit 25*a*. The controller 21 repeatedly supplies digital data dB to a driving circuit 25*b*.

The driving circuit 25*a* converts the data dA into an analog signal, and furthermore, amplifies the analog data dA to be output to the liquid ejecting head 26 as the driving signal COM-A. The driving circuit 25*b* converts the data dB into an analog signal, and furthermore, amplifies the analog data dB to be output to the liquid ejecting head 26 as the driving signal COM-B. Hardware configurations of the driving circuits 25*a* and 25*b* are the same.

In this embodiment, ink droplets may be ejected twice at maximum from the nozzles Nz in a print cycle corresponding to one pixel. By the combinations of ink droplets, four gradations of a large dot, a middle dot, a small dot, and non-recording are represented in one pixel.

The driving signal COM-A has a trapezoidal waveform Adp1 in a first half of a print cycle and a trapezoidal waveform Adp2 in a second half of the print cycle. The trapezoidal waveforms Adp1 and Adp2 have substantially the same. When the trapezoidal waveforms Adp1 and Adp2 are supplied to the discrete electrodes of the piezoelectric elements 38, middle amounts of ink are ejected from the nozzles Nz corresponding to the piezoelectric elements 38.

The driving signal COM-B has a trapezoidal waveform Bdp1 in the first half of the print cycle and a trapezoidal waveform Bdp2 in the second half of the print cycle. The trapezoidal waveforms Bdp1 and Bdp2 are different from each other. The trapezoidal waveform Bdp1 suppresses increase in viscosity of ink by finely vibrating the ink in the vicinity of the nozzles Nz. When the trapezoidal waveform Bdp1 is supplied to the discrete electrodes of the piezoelectric elements 38, ink droplets are not ejected from the nozzles Nz corresponding to the piezoelectric elements 38. When the trapezoidal waveform Bdp2 is supplied to the discrete electrodes of the piezoelectric elements 38, amounts of ink smaller than those when the trapezoidal waveforms Adp1 and Adp2 are supplied is ejected from the nozzles Nz corresponding to the piezoelectric elements 38.

When a large dot is to be formed on a certain pixel, the driving signal COM-A is selected in the first and second halves of the print cycle and is supplied to the discrete electrodes of the piezoelectric elements 38 to be driven (refer to a left side of the piezoelectric elements 38 of FIG. 4). Consequently, a middle amount of ink droplet is ejected twice. The ink of the ink droplets gathers on the medium PM so that a large dot is formed.

When a middle dot is to be formed on a certain pixel, the driving signal COM-A is selected in the first half of the print cycle, the driving signal COM-B is selected in the second half of the print cycle, and the driving signals COM-A and COM-B are supplied to the discrete electrodes of the piezoelectric elements 38 to be driven. Specifically, the trapezoidal waveforms Adp1 and Bdp2 are selected and supplied to the discrete electrodes of the piezoelectric elements 38. Consequently, a middle amount of ink droplet and a small amount of ink droplet are ejected. The ink of the ink droplets gathers on the medium PM so that a middle dot is formed.

When a small dot is to be formed in a certain pixel, the driving signals COM-A and COM-B are not selected in the first half of the print cycle, and the driving signal COM-B is selected in the second half of the print cycle and supplied to the discrete electrodes of the piezoelectric elements 38 to be driven. Specifically, the trapezoidal waveform Bdp2 is selected and supplied to the discrete electrodes of the piezoelectric elements 38. Consequently, a small amount of ink is ejected once and a small dot is formed on the medium PM.

When a dot is not recorded in a certain pixel, the driving signal COM-B is selected in the first half of the print cycle, the driving signals COM-A and COM-B are not selected in the second half of the print cycle, and the driving signal COM-B is supplied to the discrete electrodes of the piezoelectric elements 38 to be driven. Specifically, the trapezoidal waveform Bdp1 is selected and supplied to the discrete electrodes of the piezoelectric elements 38. Consequently, the ink in the vicinity of the nozzles Nz is finely vibrated in the first half of the print cycle and the ink is not ejected.

The voltage generation circuit 23 generates a holding signal having a constant voltage VBS and outputs the holding signal to the liquid ejecting head 26. The holding signal constantly holds a potential of a common electrode (refer to right side of the piezoelectric elements 38 in FIG. 4) of the plurality of piezoelectric elements 38 in an actuator substrate 26A.

The liquid ejecting head 26 includes the actuator substrate 26A and a driving IC 26D. Note that the actuator substrate 26A and the driving IC 26D are conceptually distinguished in an electric configuration, and it is not necessarily the case that these names mean that the components are realized by a single substrate or a single integrated circuit (IC).

The driving IC 26D supplies the driving signal to the discrete electrodes of the piezoelectric elements 38 of the actuator substrate 26A. The driving IC 26D relays the holding signal received from the voltage generation circuit 23 of the control unit 20 to the common electrode of the piezoelectric elements 38 on the actuator substrate 26A.

The driving IC 26D includes a selection controller 26D1 and selection sections 26D2 for the corresponding piezoelectric elements 38. The selection controller 26D1 controls selection performed by the individual selection sections 26D2. Specifically, the selection controller 26D1 stores print data supplied from the controller 21 in synchronization with a clock signal. An amount of the print data to be stored corresponds to the number of piezoelectric elements 38 of the liquid ejecting head 26. Then the selection controller 26D1 instructs the individual selection sections 26D2 to select the driving signal COM-A or the driving signal COM-B in accordance with the print data at a starting timing of the first half and a starting timing of the second half of the print cycle specified by a timing signal.

The individual selection sections 26D2 select the driving signal COM-A or the driving signal COM-B or do not select the driving signals COM-A and COM-B in response to an instruction issued by the selection controller 26D1 and apply the selected driving signal to the corresponding discrete electrodes of the piezoelectric elements 38 as driving signals of a voltage Vout.

The actuator substrate 26A includes the plurality of piezoelectric elements 38. Although one of electrodes of each of the piezoelectric elements 38 is discretely disposed, the other of the electrodes is disposed in common to the plurality of piezoelectric elements 38. Different voltages Vout for different sizes of dots to be formed are applied to the discrete electrodes of the plurality of piezoelectric elements 38 in accordance with a driving signal. A constant voltage VBS is applied to the common electrode of the plurality of piezoelectric elements 38 through a line pattern 26L in accordance with the holding signal.

Figure 5:
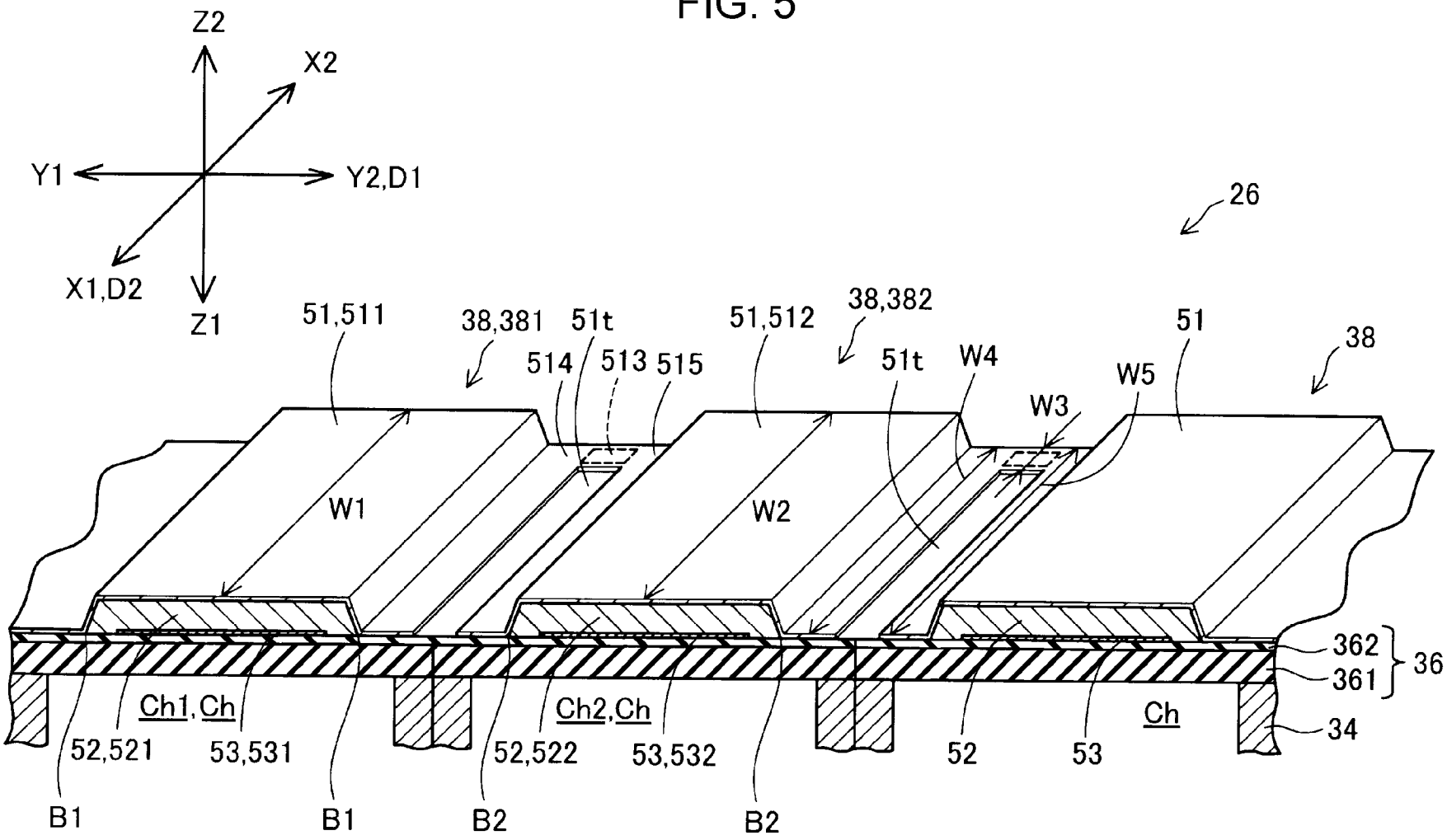
FIG. 5 is a diagram schematically illustrating configurations of a pressure chamber substrate, a vibration plate, and piezoelectric elements.

FIG. 5 is a diagram schematically illustrating configurations of the pressure chamber substrate 34, the vibration plate 36, and the piezoelectric elements 38. In the liquid ejecting head 26, a number of piezoelectric elements 38 corresponding to the number of nozzles Nz included in the nozzle line are disposed in the Y2 direction on the Z2 side relative to the vibration plate 36 (refer to FIG. 2). In FIG. 5, a configuration of a portion including three of the piezoelectric elements 38 is illustrated. In FIG. 5, components other than the pressure chamber substrate 34, the vibration plate 36, and the piezoelectric elements 38 are not illustrated for facilitating understanding of the technique.

Hereinafter, the configurations of the pressure chamber substrate 34, the vibration plate 36, and the piezoelectric elements 38 will be described while a direction indicated by the arrow mark Y2 in the Y direction is referred to as a "first direction D1" and a direction indicated by the arrow mark X1 in the X direction is referred to as a "second direction D2". Hereinafter, a configuration and a function of a piezoelectric element will be described mainly taking configurations of piezoelectric elements 381 and 382 in the three piezoelectric elements 38 illustrated in FIG. 5 and a peripheral portion as examples.

The liquid ejecting head 26 includes a first piezoelectric body 521, a second piezoelectric body 522, a first electrode 531, a second electrode 532, and a third electrode 51 as some of components of the plurality of piezoelectric elements 38.

The second piezoelectric body 522 is disposed in a position different from the first piezoelectric body 521 in the first direction D1. Specifically, the second piezoelectric body 522 is disposed adjacent to the first piezoelectric body 521 in the first direction D1. Note that an expression "a piezoelectric body A and a piezoelectric body B are adjacent to each other" means that another piezoelectric body does not exist between the piezoelectric body A and the piezoelectric body B. When the piezoelectric bodies including the first piezoelectric body 521 and the second piezoelectric body 522 are described without distinction, the piezoelectric bodies are referred to as "piezoelectric bodies 52".

The first electrode 531 is electrically coupled to the first piezoelectric body 521 but not electrically coupled to the second piezoelectric body 522. The second electrode 532 is electrically coupled to the second piezoelectric body 522 but not electrically coupled to the first piezoelectric body 521. The first electrode 531 and the second electrode 532 are discrete electrodes coupled to the respective piezoelectric elements 38 (refer to left side of the piezoelectric elements 38 in FIG. 4). Specifically, different driving signals are supplied depending on an ejection amount of ink from the driving IC 26D to the first electrode 531 coupled to the first piezoelectric body 521 (refer to the left side of the piezoelectric elements 38 in FIG. 4). Different driving signals are supplied depending on an ejection amount of ink from the driving IC 26D also to the second electrode 532 coupled to the second piezoelectric body 522. When the discrete electrodes coupled to the piezoelectric elements 38 including the first and second electrodes 531 and 532 are described without distinction, the electrodes are referred to as "electrodes 53".

The third electrode 51 is electrically coupled to the first and second piezoelectric bodies 521 and 522. The third electrode 51 is a common electrode of the piezoelectric elements 38 (refer to the right side of the piezoelectric elements 38 in FIG. 4). A holding signal having a constant voltage irrespective of an ejection amount of ink is supplied from the voltage generation circuit 23 to the third electrode 51 coupled to the piezoelectric elements 38 (refer to the right side of the piezoelectric elements 38 in FIG. 4). A thickness of the third electrode 51 is several tens of nanometers.

The third electrode 51 is configured by a single member. The third electrode 51 covers the first piezoelectric body 521 and further covers the second piezoelectric body 522. With this configuration, the possibility that liquid, such as water generated due to moisture condensation or ink, intrudes into a gap between the vibration plate 36 including the piezoelectric bodies 521 and 522 disposed thereon and the piezoelectric bodies 521 and 522 may be reduced.

A first pressure chamber Ch1 which is one of the pressure chambers Ch is disposed on a side opposite to a side of the piezoelectric element 381 relative to the vibration plate 36. The first pressure chamber Ch1 accommodates ink and applies pressure to the accommodated ink by distortion of the first piezoelectric body 521. A second pressure chamber Ch2 which is one of the pressure chambers Ch is disposed on a side opposite to a side of the piezoelectric element 382 relative to the vibration plate 36. The second pressure chamber Ch2 accommodates ink and pressure is applied to the accommodated ink by distortion of the second piezoelectric body 522.

When viewed from the first pressure chamber Ch1, the first electrode 531, the first piezoelectric body 521, and the third electrode 51 are disposed in this order from a near side of the first pressure chamber Ch1. When viewed from the second pressure chamber Ch2, the second electrode 532, the second piezoelectric body 522, and the third electrode 51 are disposed in this order from a near side of the second pressure chamber Ch2. In other words, the first piezoelectric body 521 is disposed between the first electrode 531 and the third electrode 51 in the Z direction. Furthermore, the second piezoelectric body 522 is disposed between the second electrode 532 and the third electrode 51 in the Z direction. Specifically, the third electrode 51 electrically coupled to both the first piezoelectric body 521 and the second piezoelectric body 522 is disposed on a side opposite to the first pressure chamber Ch1 and the second pressure chamber Ch2 relative to the first piezoelectric body 521 and the second piezoelectric body 522.

The liquid ejecting head 26 is normally disposed such that the piezoelectric bodies 52 are disposed on an upper side relative to the pressure chambers Ch and ink is ejected downward relative to the pressure chambers Ch. Therefore, according to this embodiment, the third electrode 51 seals at least a portion of ends of the first piezoelectric body 521 and ends of the second piezoelectric body 522 from above. Accordingly, the possibility that liquid, such as water generated by moisture condensation or ink, intrudes into a gap between the vibration plate 36 including the piezoelectric bodies 52 and the piezoelectric bodies 52 may be reduced.

The third electrode 51 includes a first portion 511, a second portion 512, a third portion 513, a fourth portion 514, and a fifth portion 515.

The first portion 511 of the third electrode 51 is disposed in a position corresponding to the first piezoelectric body 521. Specifically, the first portion 511 of the third electrode 51 faces the first electrode 531 with the first piezoelectric body 521 interposed therebetween. A width of the first portion 511 in the second direction D2 is a first width W1.

The second portion 512 of the third electrode 51 is disposed in a position corresponding to the second piezoelectric body 522. Specifically, the second portion 512 of the third electrode 51 faces the second electrode 532 with the second piezoelectric body 522 interposed therebetween. A width of the second portion 512 in the second direction D2 is a second width W2. The second width W2 is equal to the first width W1.

A resistance value of the first portion 511 in the second direction D2 is 1/20 or more of an inverse number of a maximum current obtained when driving is performed with a voltage gradient of 35 V/μsec from a coercive electric field of the first piezoelectric body 521. A resistance value of the second portion 512 in the second direction D2 is 1/20 or more of an inverse number of a maximum current obtained when driving is performed with a voltage gradient of 35 V/μsec from a coercive electric field of the second piezoelectric body 522.

With this configuration, a voltage drop in the first portion 511 in the second direction D2 and a voltage drop of the second portion 512 in the second direction D2 are 0.05 V or more. Accordingly, it is effective that differences between potential differences between the first portion 511 and the first electrode 531 in positions in the second direction D2 when a potential Vout which is different from a potential applied to the third electrode 51 is applied to the second electrode 532 and the first electrode 531 is in an Off state and potential differences between the first portion 511 and the first electrode 531 in the positions in the second direction D2 when a potential Vout which is different from a potential applied to the third electrode 51 is applied to the first electrode 531 and the second electrode 532 are small. This technical effect will be described hereinafter.

The third portion 513 of the third electrode 51 is disposed between the first piezoelectric body 521 and the second piezoelectric body 522. The third portion 513 is disposed on a surface of the vibration plate 36 without the piezoelectric bodies 52. A width of the third portion 513 in the second direction D2 is a third width W3. The third width W3 is smaller than the first width W1 and the second width W2. Specifically, the third width W3 is 1/10 of the first width W1 or the second width W2.

The fourth portion 514 is disposed between the first portion 511 and the third portion 513 in the third electrode 51. The fourth portion 514 is disposed near the first portion 511 in the Y direction relative to the third portion 513. The fourth portion 514 covers a boundary B1 between a surface of the insulating layer 362 of the vibration plate 36 being in contact with the first piezoelectric body 521 and the first piezoelectric body 521. A width of the fourth portion 514 in the second direction D2 is a fourth width W4. The fourth width W4 is larger than the third width W3. Specifically, the fourth width W4 is equal to the first width W1 and the second width W2.

The fifth portion 515 is disposed between the second portion 512 and the third portion 513 in the third electrode 51. The fifth portion 515 is disposed near the second portion 512 in the Y direction relative to the third portion 513. The fifth portion 515 covers a boundary B2 between a surface of the insulating layer 362 of the vibration plate 36 being in contact with the second piezoelectric body 522 and the second piezoelectric body 522. A width of the fifth portion 515 in the second direction D2 is a fifth width W5. The fifth width W5 is larger than the third width W3. Specifically, the fifth width W5 is equal to the first width W1, the second width W2, and the fourth width W4. In FIG. 5, a region which is between the fourth portion 514 and the fifth portion 515 in the first direction D1 and which does not include the third electrode 51 is illustrated as a division section 51*t*.

With this configuration, the boundaries B1 and B2 may be sealed by the third electrode 51 in a wider range when compared with a state in which the third portion 513 is disposed between the first and second piezoelectric bodies 521 and 522 and the fourth portion 514 and the fifth portion 515 are not disposed. Therefore, the possibility that liquid, such as water generated by moisture condensation or ink, intrudes into a gap between a surface of the insulating layer 362 of the vibration plate 36 which is in contact with the piezoelectric bodies 52 and the piezoelectric bodies 52 may be reduced.

Figure 6:
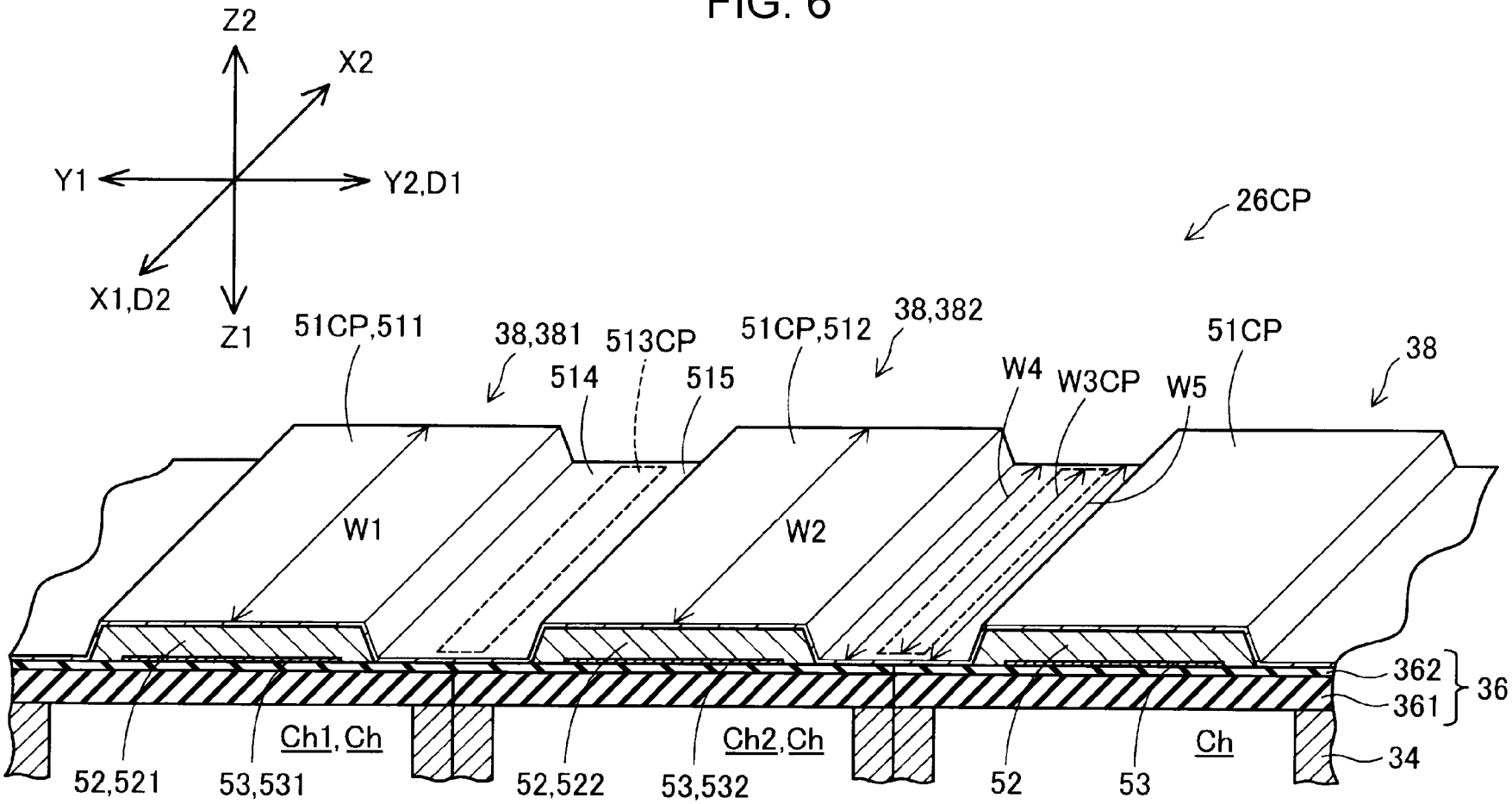
FIG. 6 is a diagram schematically illustrating configurations of a pressure chamber substrate, a vibration plate, and a piezoelectric element in a liquid ejecting head according to a comparative example.

FIG. 6 is a diagram schematically illustrating a configuration of a pressure chamber substrate 34, a vibration plate 36, and piezoelectric elements 38 in the liquid ejecting head 26CP according to a comparative example. In the liquid ejecting head 26CP, the division section 51*t* is not disposed, and a width W3CP of a third portion 513CP is equal to a first width W1 and a second width W2. The other configurations of the liquid ejecting head 26CP are the same as those of the liquid ejecting head 26 in the foregoing embodiment. Hereinafter, description will be made while operation of the liquid ejecting head 26 of this embodiment is compared with operation of the liquid ejecting head 26CP of the comparative example.

A2. Operation of Liquid Ejecting Head

A2-1. Operation of Liquid Ejecting Head of this Embodiment

Figure 7:
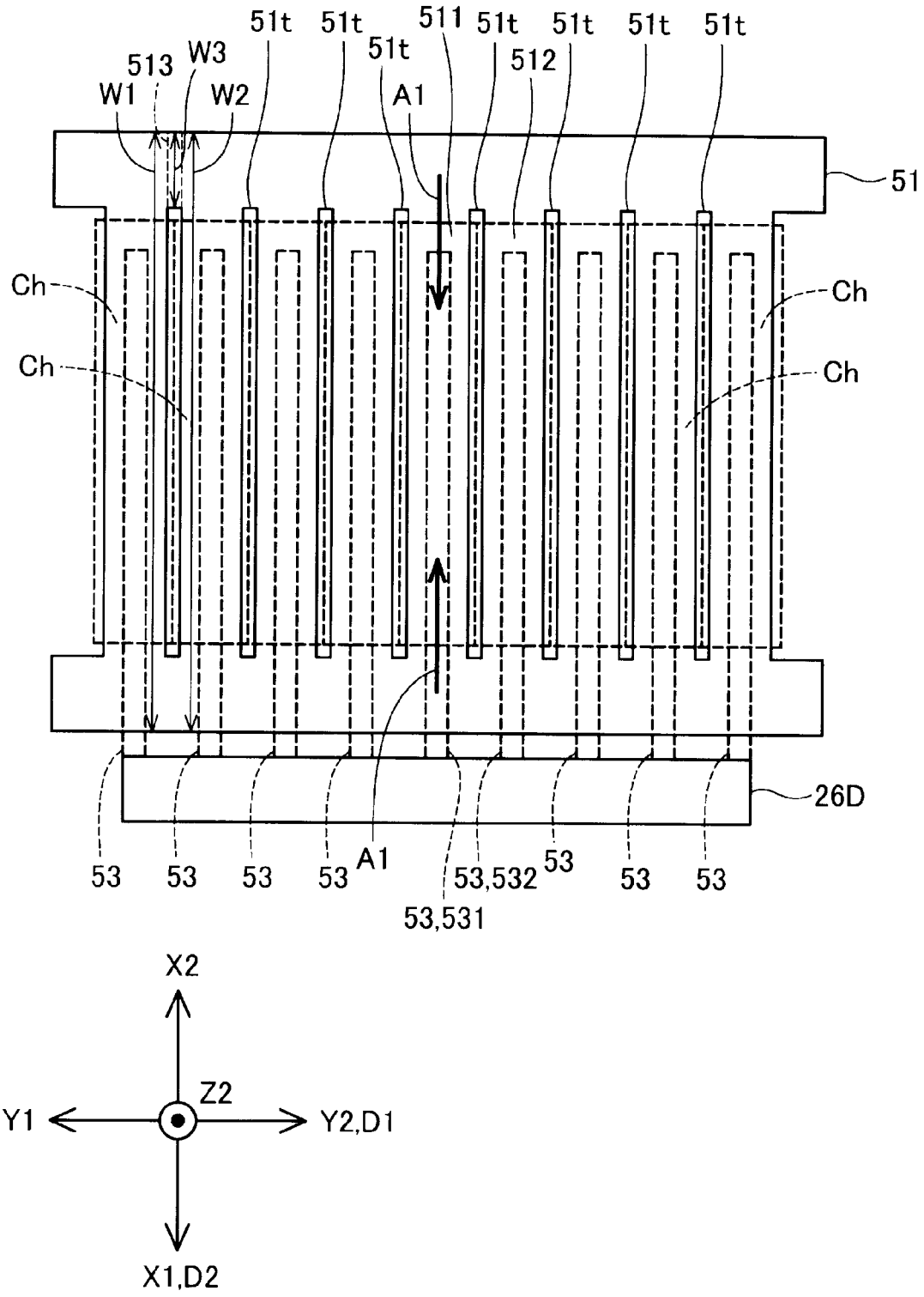
FIG. 7 is a plan view illustrating discrete electrodes coupled to the respective piezoelectric elements, a third electrode which is in common to the individual piezoelectric elements, and pressure chambers corresponding to the piezoelectric elements.

FIG. 7 is a plan view illustrating the discrete electrodes 53 coupled to the individual piezoelectric elements 38, the third electrode 51 which is in common to the individual piezoelectric elements 38, and pressure chambers Ch corresponding to the piezoelectric elements 38. FIG. 7 is a diagram illustrating the relationship among the discrete electrodes 53, the third common electrode 51, and the pressure chambers Ch, and actual sizes and actual shapes of the configurations are not reflected. For example, the driving IC 26D illustrated in FIG. 7 may not be actually disposed in a position illustrated in FIG. 7, but a potential is applied from a side illustrated in FIG. 7 to the discrete electrodes 53 by the driving IC 26D. Note that potentials are applied from both side in the X direction to the third electrode 51 by the voltage generation circuit 23.

It is assumed that, among the plurality of discrete electrodes 53 included in the liquid ejecting head 26, only the electrode 531 is turned on and the other discrete electrodes 53 are turned off (refer to 26D2 in FIG. 4). Here, in the first portion 511 facing the first electrode 531 with the first piezoelectric body 521 interposed therebetween, a potential VBS is applied by the voltage generation circuit 23 from both ends in the X direction (refer to arrow marks A1). As a result, in the first portion 511 of the third electrode 51, different potentials are applied in portions in the vicinity of the ends in the X direction and a portion in the vicinity of the center due to resistance of the first portion 511.

Figure 8:
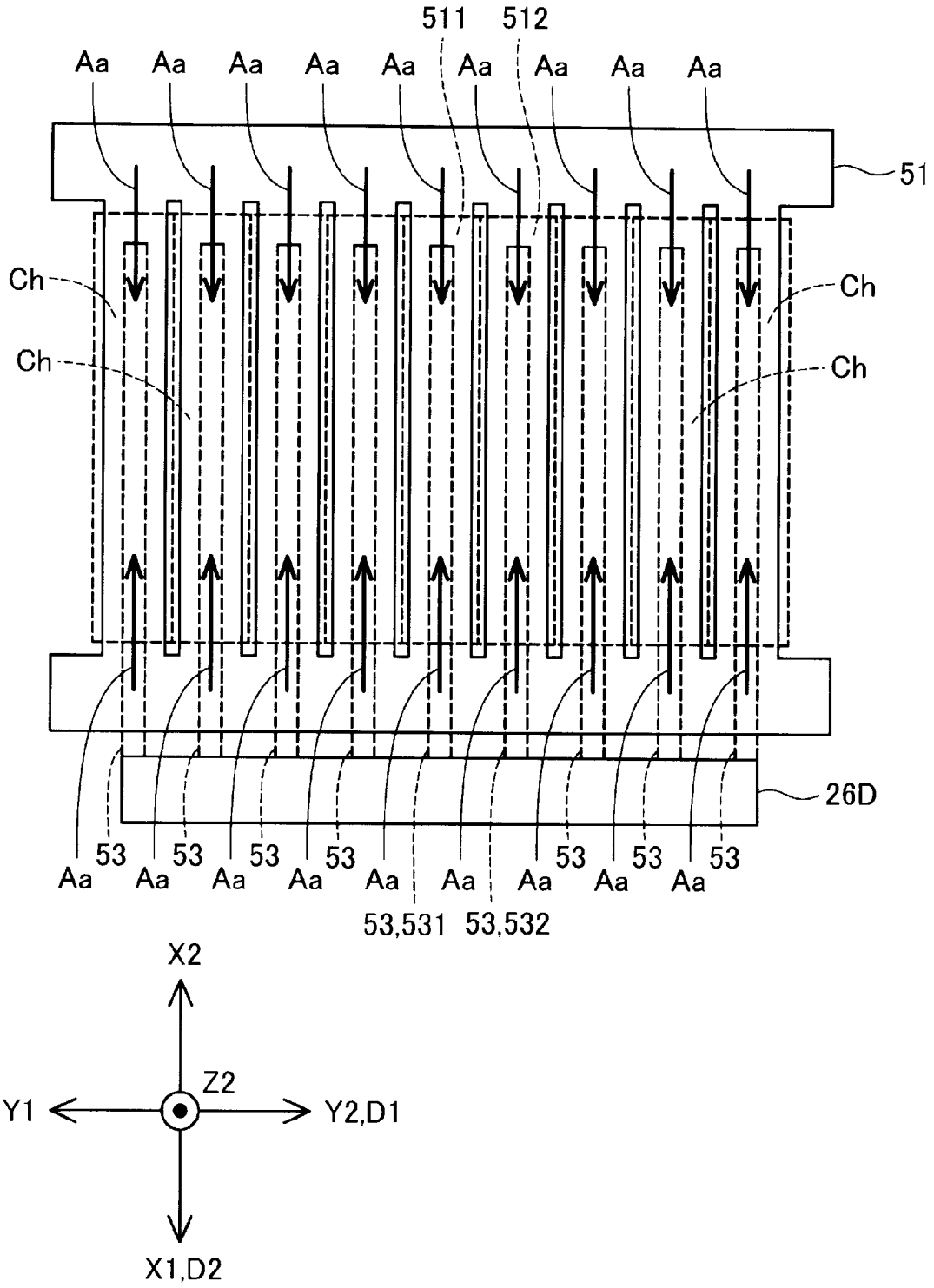
FIG. 8 is a plan view illustrating discrete electrodes coupled to respective piezoelectric elements, a third electrode which is in common to the individual piezoelectric elements, and pressure chambers corresponding to the piezoelectric elements.

FIG. 8 is a plan view illustrating the discrete electrodes 53 coupled to the individual piezoelectric elements 38, the third electrode 51 which is common to the piezoelectric elements 38, and the pressure chambers Ch corresponding to the piezoelectric elements 38. As with FIG. 7, FIG. 8 is a diagram illustrating the relationship among the discrete electrodes 53, the third common electrode 51, and the pressure chambers Ch, and actual sizes and actual shapes of the configurations are not reflected.

It is assumed that all the discrete electrodes 53 included in the liquid ejecting head 26 are turned on (refer to 26D2 in FIG. 4). In this case, in portions of the third electrode 51 facing the individual electrodes 53 with the piezoelectric bodies 52 interposed therebetween, the potential VBS is applied by the voltage generation circuit 23 from the both ends in the X direction similarly to the case where only the electrode 531 is turned on (refer to arrow marks Aa of FIG. 8 and the arrow marks A1 of FIG. 7). As a result, also in this case, in the first portion 511 of the third electrode 51, different potentials are applied in the portions in the vicinity of the ends in the X direction and the portion in the vicinity of the center due to resistance of the first portion 511.

Figure 9:
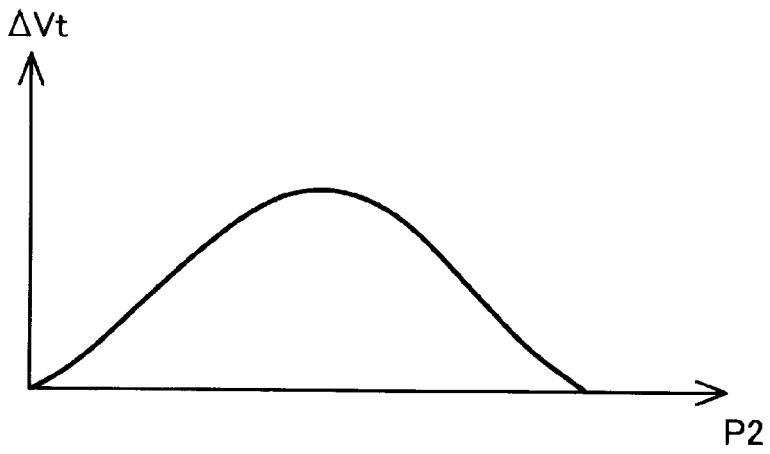
FIG. 9 is a graph of differences between potentials in positions in a first portion of the third electrode in an X2 direction and potentials in opposite ends of the first portion.

FIG. 9 is a graph of differences ΔVt between potentials in positions P2 in the X2 direction in the first portion 511 of the third electrode 51 and potentials in the both end portions of the first portion 511. As illustrated in FIG. 7, when only the electrode 531 is turned on, the potential VBS is applied by the voltage generation circuit 23 from the both ends in the X direction to the first portion 511 (refer to the arrow marks A1 in FIG. 7). Consequently, in the first portion 511, the differences ΔVt between potentials in the positions P2 in the X2 direction and the potentials in the both end portions of the first portion 511 are illustrated in FIG. 9 due to a resistance of the first portion 511.

As illustrated in FIG. 8, also when all the plurality of discrete electrodes 53 included in the liquid ejecting head 26 are turned on, the potential VBS is applied by the voltage generation circuit 23 from the both ends in the X direction to the first portion 511 (refer to the arrow marks Aa in FIG. 8). Consequently, in the first portion 511, the differences ΔVt between potentials in the positions P2 in the X2 direction and the potentials in the both end portions of the first portion 511 are substantially illustrated in FIG. 9 due to a resistance of the first portion 511. Specifically, both when only the electrode 531 is turned on and when all the discrete electrodes 53 are turned on, the differences ΔVt between the potentials in the positions P2 in the X2 direction and the potentials in the both end portions of the first portion 511 substantially match each other.

Figure 10:
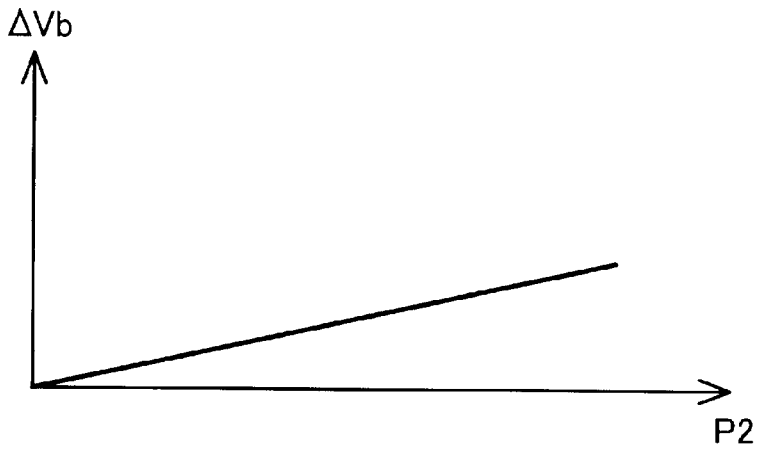
FIG. 10 is a diagram illustrating a difference between potentials in positions of the first electrode in the X2 direction and a potential in an end on a side coupled to a driving IC.

FIG. 10 is a diagram illustrating differences ΔVb between potentials in the positions P2 of the first electrode 531 in the X2 direction and a potential in an end portion on a side coupled to the driving IC 26D of the first electrode 531 (refer to lower portions in FIGS. 7 and 8). In the first electrode 531, a potential Vout is applied by the driving IC 26D from an end in the X1 direction. As a result, in the first electrode 531, different potentials are applied in a portion in the vicinity of the end in the X1 direction and the other portions due to resistance of the first electrode 531. In the first electrode 531, differences ΔVb between potentials in positions of the first electrode in the X2 direction and potentials in end portions in the X1 direction of the first electrode 531 are illustrated in FIG. 10.

A method for applying the potential Vout to the sections in the first electrode 531 is the same irrespective of whether only the electrode 531 is turned on or whether all the discrete electrodes 53 are turned on. Therefore, in the first electrode 531, the potential differences ΔVb between potentials in the portions and the potentials of the end portions are illustrated in FIG. 10 irrespective of whether only the electrode 531 is turned on or whether all the discrete electrodes 53 are turned on.

Figure 11:
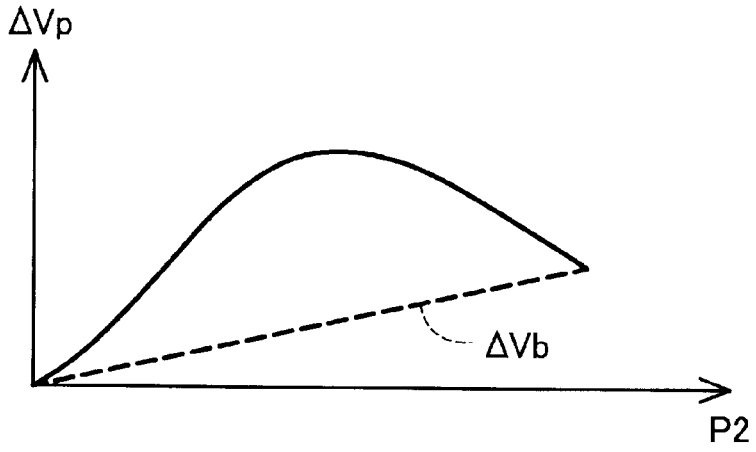
FIG. 11 is a diagram illustrating shifts of a potential difference between the first portion of the third electrode and the first electrode in the positions in the X2 direction relative to a potential difference in an end in an X1 direction.

FIG. 11 is a diagram illustrating a shift ΔVp of a potential difference between the first portion 511 of the third electrode 51 and the first electrode 531 in the positions P2 in the X2 direction relative to a potential difference in the end in an X1 direction of the first electrode 531. The shift ΔVp of the potential difference is obtained by superposing ΔVt and ΔVb.

As described above, when only the electrode 531 is turned on, the potential difference ΔVt is illustrated in FIG. 9 and the potential difference ΔVb is illustrated in FIG. 10. Therefore, when only the electrode 531 is turned on, shifts ΔVp of the potential differences in the positions P2 in the X2 direction relative to the potential differences in the end portions in the X1 direction are illustrated in FIG. 11.

Similarly, as described above, also when all the discrete electrodes 53 are turned on, the potential differences ΔVt are as illustrated in FIG. 9 and the potential differences ΔVb are as illustrated in FIG. 10. Accordingly, when all the electrodes 53 are turned on, shifts ΔVp of the potential difference in the positions P2 in the X2 direction from the potential differences in the end portions in the X1 direction are as illustrated in FIG. 11.

Specifically, in this embodiment, the same ΔVp is obtained both when only the electrode 531 is turned on and when all the discrete electrodes 53 are turned on (refer to FIG. 11).

A2-2. Operation of Liquid Ejecting Head in Comparative Example

A liquid ejecting head 26CP which does not include the division section 51*t* for dividing portions in the common electrode facing the discrete electrodes 53 (refer to FIGS. 5 to 7) is described as a comparative example. In the comparative example, a case where only the electrode 531 is turned on is described first, and thereafter, a case where all the discrete electrodes are turned on is described.

1. In Case Only One Electrode 531 Turned on

Figure 12:
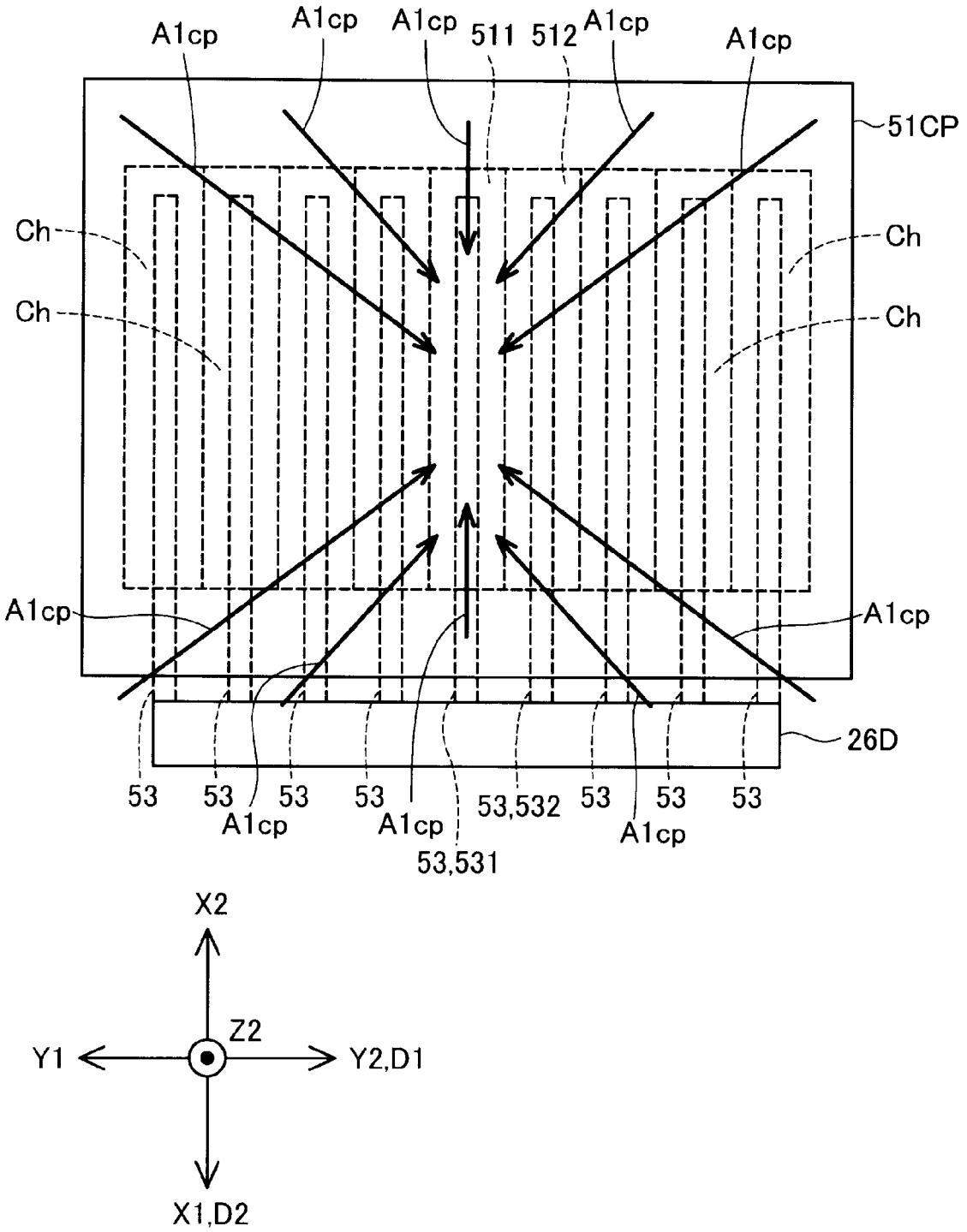
FIG. 12 is a plan view illustrating discrete electrodes 53, a common third electrode, and pressure chambers included in a liquid ejecting head according to a comparative example.

FIG. 12 is a plan view illustrating discrete electrodes 53, a common third electrode 51CP, and pressure chambers Ch included in the liquid ejecting head 26CP according to the comparative example. Actual sizes and actual shapes of the configurations are not reflected in FIG. 12. The liquid ejecting head 26CP does not include the division section 51*t* for dividing portions in the common electrode facing the discrete electrodes 53 (refer to FIGS. 5 to 7).

It is assumed that, among the plurality of discrete electrodes 53 included in the liquid ejecting head 26CP, only the electrode 531 is turned on and the other discrete electrodes 53 are turned off (refer to 26D2 in FIG. 4). Here, in the first portion 511 facing the first electrode 531 with the first piezoelectric body 521 interposed therebetween, the potential VBS is applied by the voltage generation circuit 23 from various directions of the first portion 511 (refer to arrow marks A1*cp*). Consequently, in the first portion 511 of the third electrode 51CP, differences between potentials in the vicinity of ends in the X direction and a potential in the vicinity of a center are little.

Figure 13:
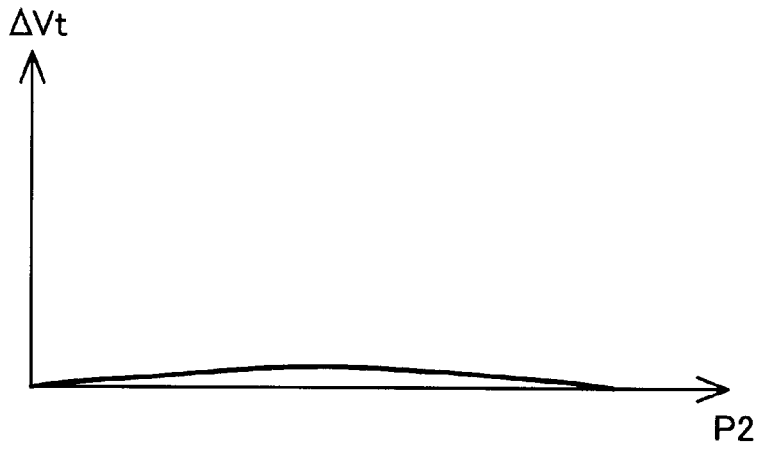
FIG. 13 is a diagram illustrating differences between potentials in positions in a first portion of the third electrode of the liquid ejecting head in an X2 direction and potentials in opposite ends of the first portion.

FIG. 13 is a diagram illustrating differences ΔVt between potentials in the positions P2 in the X2 direction in the first portion 511 of the third electrode 51CP in the liquid ejecting head 26CP and potentials in both end portions of the first portion 511. When only the electrode 531 is turned on in the liquid ejecting head 26CP, the potential VBS is applied by the voltage generation circuit 23 from various directions to the first portion 511 (refer to the arrow marks A1*cp* in FIG. 12). Specifically, this state is different from the case where only the electrode 531 included in the liquid ejecting head 26 is turned on in the first embodiment illustrated with reference to FIG. 9. Consequently, in the first portion 511, differences ΔVt between the potentials in the positions P2 in the first portion 511 in the X2 direction and the potentials in the both end portions of the first portion 511 are illustrated in FIG. 13. As is apparent from comparison between FIGS.

13 and 9, the potential differences ΔVt obtained when only the electrode 531 included in the liquid ejecting head 26CP according to the comparative example is turned on and the potential differences ΔVt obtained when only the electrode 531 included in the liquid ejecting head 26 according to the first embodiment is turned on have totally different tendencies.

Figure 14:
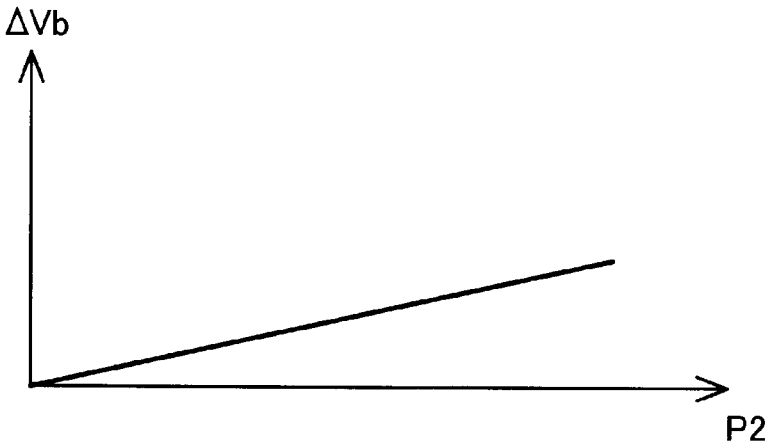
FIG. 14 is a diagram illustrating differences between potentials in the positions in the X2 direction of the first electrode of the liquid ejecting head and potentials in an end portion of the first electrode on a side coupled to the driving IC.

FIG. 14 is a diagram illustrating differences between potentials in the positions P2 in the X2 direction of the first electrode 531 of the liquid ejecting head 26CP and potentials in an end portion of the first electrode 531 on a side coupled to the driving IC 26D (refer to a lower portion in FIG. 12). Also in the first electrode 531 of the liquid ejecting head 26CP, a potential Vout is applied by the driving IC 26D from the end in the X1 direction. Consequently, in the first electrode 531, differences ΔVb between potentials in the positions of the first electrode 531 in the X2 direction and potentials in the end portion in the X1 direction of the first electrode 531 are illustrated in FIG. 14.

Figure 15:
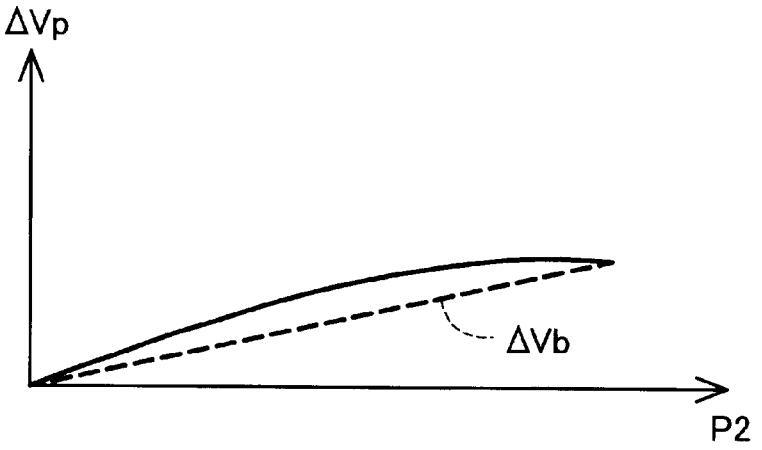
FIG. 15 is a diagram illustrating shifts ΔVp of potential differences between a first portion of a third electrode of the liquid ejecting head and a first electrode in the positions in the X2 direction relative to potential differences in the end in the X1 direction of the first electrode.

FIG. 15 is a diagram illustrating shifts ΔVp of potential differences between the first portion 511 of the third electrode 51CP of the liquid ejecting head 26CP and the first electrode 531 in the positions P2 in the X2 direction relative to potential differences in the end in the X1 direction of the first electrode 531. The shifts ΔVp of the potential differences are obtained by superposing ΔVt and ΔVb (refer to FIGS. 13 and 14).

2. In Case of all Discrete Electrodes 53 Turned on

Figure 16:
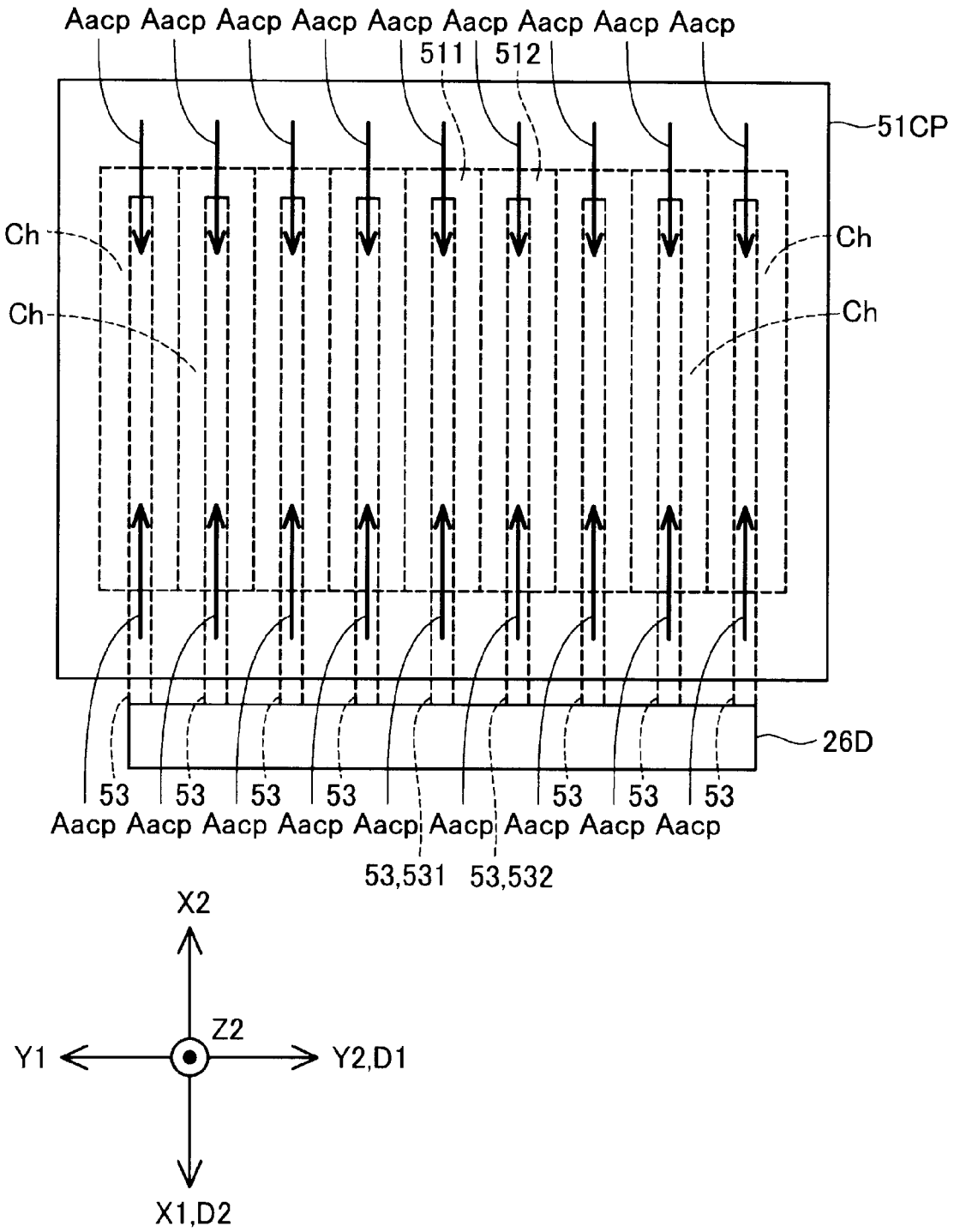
FIG. 16 is a plan view illustrating the discrete electrodes of the liquid ejecting head according to the comparative example, the third electrode which is in common to the piezoelectric elements, and the pressure chambers corresponding to the piezoelectric elements.

FIG. 16 is a plan view illustrating the discrete electrodes 53 of the liquid ejecting head 26CP according to the comparative example, the third electrode 51CP which is in common to the piezoelectric elements 38, and the pressure chambers Ch corresponding to the piezoelectric elements 38. As with FIG. 12, FIG. 16 is a diagram illustrating the relationship among the discrete electrodes 53, the common third electrode 51CP, and the pressure chambers Ch, and actual sizes and actual shapes of the configurations are not reflected.

It is assumed that all the discrete electrodes 53 included in the liquid ejecting head 26CP are turned on (refer to 26D2 in FIG. 4). In this case, in portions of the third electrode 51CP facing the individual electrodes 53 with the piezoelectric bodies 52 interposed therebetween, the potential VBS is applied by the voltage generation circuit 23 from the both ends in the X direction similarly to the embodiment illustrated in FIG. 8 (refer to arrow marks Aacp of FIG. 16). Consequently, also in this case, similarly to the embodiment illustrated in FIG. 8, in the first portion 511 of the third electrode 51CP, different potentials are applied to portions in the vicinity of the ends in the X direction and a portion in the vicinity of the center due to resistance of the first portion 511.

Figure 17:
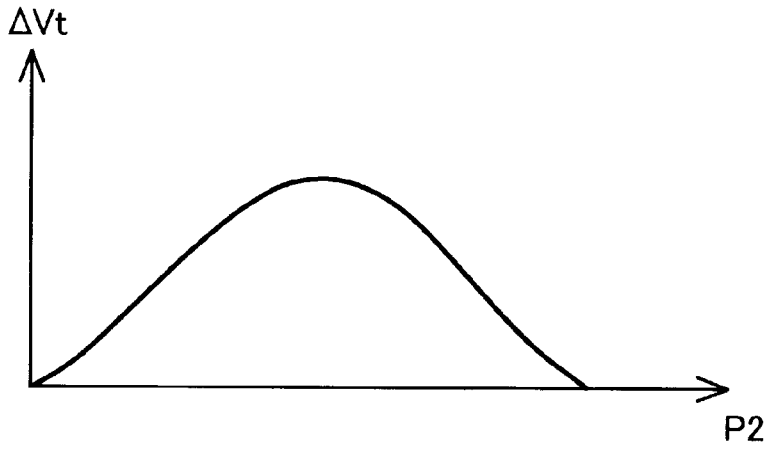
FIG. 17 is a diagram illustrating differences between potentials in positions in the first portion of the third electrode of the liquid ejecting head in the X2 direction and potentials in opposite ends of the first portion.

FIG. 17 is a diagram illustrating differences ΔVt between potentials in the positions P2 in the X2 direction in the first portion 511 of the third electrode 51CP of the liquid ejecting head 26CP and potentials in both end portions of the first portion 511. When all the plurality of discrete electrodes 53 included in the liquid ejecting head 26CP are turned on, the potential VBS is applied by the voltage generation circuit 23 from the both ends in the X direction to the first portion 511 (refer to the arrow marks Aacp in FIG. 16). Specifically, this state is the same as the state in which all the electrodes 53 included in the liquid ejecting head 26 illustrated with reference to FIG. 9 are turned on in the first embodiment. Consequently, in the first portion 511, the differences ΔVt between potentials in the positions P2 of the first portion 511 in the X2 direction and the potentials in the both end portions of the first portion 511 are illustrated in FIG. 17 due to a resistance of the first portion 511. As is apparent from comparison between FIGS. 17 and 9, the potential differences ΔVt obtained when all the discrete electrodes 53 included in the liquid ejecting head 26CP according to the comparative example are turned on and the potential differences ΔVt obtained when all the discrete electrodes 53 included in the liquid ejecting head 26 according to the first embodiment are turned on have similar tendency.

As is apparent from comparison between FIGS. 13 and 17, in the liquid ejecting head 26CP of the comparative example, the differences ΔVt between the potentials in the positions P2 in the X2 direction and potentials in the both end portions of the first portion 511 obtained when only the electrode 531 is turned on and the differences ΔVt between the potentials in the positions P2 in the X2 direction and potentials in the both end portions of the first portion 511 obtained when all the discrete electrodes 53 are turned on are considerably different from each other.

Figure 18:
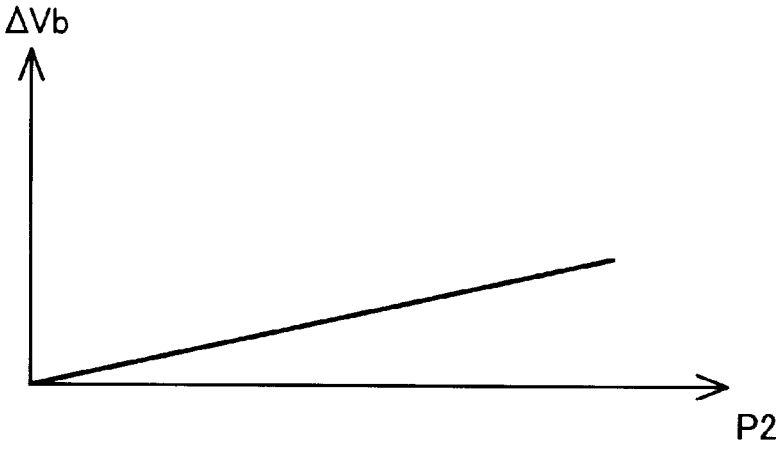
FIG. 18 is a diagram illustrating differences between potentials in the positions in the X2 direction of the first electrode of the liquid ejecting head and potentials in an end portion of the first electrode on a side coupled to the driving IC.

FIG. 18 is a diagram illustrating differences between potentials in the positions P2 in the X2 direction of the first electrode 531 of the liquid ejecting head 26CP and a potential in the end portion on the side coupled to the driving IC 26D of the first electrode 531 (refer to lower portions in FIG. 16). A method for applying the potential Vout to the sections in the first electrode 531 in the liquid ejecting head 26CP is the same irrespective of whether only the electrode 531 is turned on or whether all the discrete electrodes 53 are turned on. Therefore, the potential differences ΔVb relative to the potentials of the end portions of the sections of the first electrode 531 are the same as the state in which only the electrodes 531 is turned on as illustrated in FIG. 14.

Figure 19:
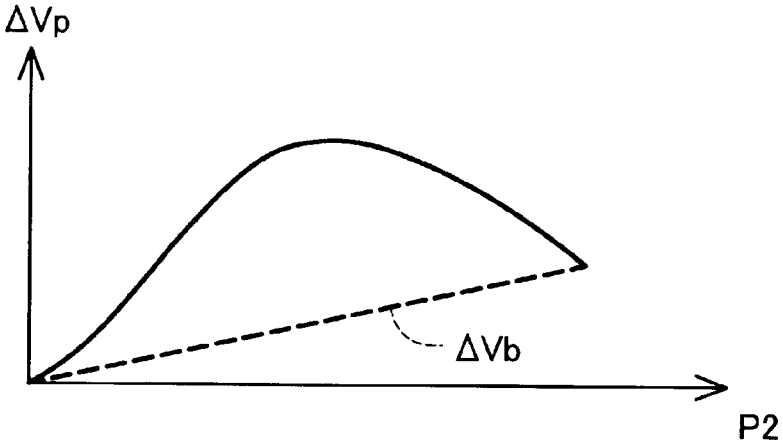
FIG. 19 is a diagram illustrating shifts ΔVp of potential differences between a first portion of a third electrode of the liquid ejecting head and a first electrode in the positions in the X2 direction relative to potential differences in the end portion in the X1 direction of the first electrode.

FIG. 19 is a diagram illustrating shifts ΔVp of potential differences between the first portion 511 of the third electrode 51CP of the liquid ejecting head 26CP and the first electrode 531 in the positions in the X2 direction relative to potential differences in the end portion in the X1 direction of the first electrode 531. The shifts ΔVp of the potential differences are obtained by superposing ΔVt and ΔVb. As is apparent from comparison between FIGS. 15 and 19, in the liquid ejecting head 26CP of the comparative example, the shifts ΔVp of potential differences in the positions P2 in the X2 direction relative to the potential differences in the end portion in the X1 direction obtained when only the electrode 531 is turned on and the shifts ΔVp of potential differences in the positions P2 in the X2 direction relative to the potential differences in the end portion in the X1 direction obtained when all the discrete electrodes 53 are turned on are considerably different from each other.

3. Comparison Between First Embodiment and Comparative Example

As is apparent from comparison between FIGS. 15 and 19, in the comparative example, the shifts ΔVp of potential differences obtained when only the electrode 531 is turned on are different from the shifts ΔVp of potential differences obtained when all the plurality of discrete electrodes 53 are turned on. Therefore, ejection characteristics of ink ejected from one of the nozzles corresponding to the electrode 531 when only the electrode 531 is turned on is different from ejection characteristics of ink ejected from the nozzle corresponding to the electrode 531 when all the plurality of discrete electrodes 53 are turned on (in terms of an ejection amount, an ejection speed, and the like).

On the other hand, as is apparent from FIG. 11, in the first embodiment, shifts ΔVp of potential differences obtained when only the electrode 531 is turned on are the same as shifts ΔVp of potential differences obtained when all the plurality of discrete electrodes 53 are turned on. Therefore, ejection characteristics of ink ejected from one of the nozzles corresponding to the electrode 531 when only the electrode 531 is turned on is the same as ejection characteristics of ink ejected from the nozzle corresponding to the electrode 531 when all the plurality of discrete electrodes 53 are turned on.

The reason of this will be briefly described. In the comparative example, when only the electrode 531 is turned on, differences of potentials in the vicinity of ends in the X direction and in the vicinity of the center is not large as illustrated in FIG. 15. Since the third electrode 51 is not particularly divided, potentials are applied to the portion in the vicinity of the center from various directions in the XY plane as illustrated in FIG. 12 when only the electrode 531 is turned on, and therefore, differences between potentials in the portions in the vicinity of the end portions and potentials in the portion in the vicinity of the center are seldom generated.

On the other hand, when all the plurality of discrete electrodes 53 are turned on, differences between the potentials in the vicinity of the end portions in the X direction and the potential in the vicinity of the center are generated to some extent as illustrated in FIG. 19. This is because, when all the plurality of discrete electrodes 53 are turned on, a potential is not applied in a concentrated manner to a particular one of the discrete electrodes 53 even when the third electrode is not divided. Specifically, potentials are applied to the individual discrete electrodes 53 from the end portions in the X direction in the XY plane as illustrated in FIG. 16, and potentials are seldom applied from various directions in the XY plane as illustrated in FIG. 12. For example, when the electrode 531 is focused, although potentials are applied from the end portions in the X direction since the electrode 531 is in an ON state, an electrode 532 positioned adjacent to the electrode 531 in the Y direction is also turned on and a potential is applied to the electrode 532, and therefore, a potential is seldom applied in the Y direction to the electrode 531. Consequently, differences ΔVp of potentials in the vicinity of the end portions and potentials in the vicinity of the center portion are large.

On the other hand, in the first embodiment, the third electrode 51 is divided. Specifically, in the third portion 513 positioned between the first piezoelectric body 521 and the second piezoelectric body 522, the third electrode 51 has the width in the second direction D2 smaller than those of the first portion 511 and the second portion 512 (refer to W1 to W3 in FIGS. 5 and 7).

Therefore, even when only one electrode is turned on, a potential is not transmitted in the division section, and accordingly, it is difficult to apply a potential to one electrode in the Y direction as illustrated in FIG. 8. Accordingly, in the first embodiment, potential differences ΔVp obtained when only one electrode is turned on are not so different from potential differences ΔVp obtained when all the plurality of electrodes are turned on. By this, ink may be ejected without differentiating the ejection characteristics irrespective of the number of electrodes turned on.

Note that, although change of differences ΔVp of the potentials due to the number of electrodes turned on may be suppressed in the first embodiment, the differences ΔVp of the potentials in the vicinity of the end portions and in the vicinity of the center portion are generated as illustrated in FIG. 11. Note that the potential differences ΔVp do not depend on the number of electrodes turned on, that is, are values fixed to some extent. Therefore, the potential differences ΔVp may be suppressed to some extent by controlling resistances in the various positions in the third electrode 51 or changing a potential (a voltage) to be applied.

Note that, in the liquid ejecting head 26 of this embodiment, the third width W3 of the third portion 513 in the second direction D2 is smaller than half of the first width W1 of the first portion 511 in the second direction D2 and smaller than half of the second width W2 of the second portion 512 in the second direction D2 (refer to FIG. 5). With this configuration, the following effect is obtained when compared with a mode in which the third width W3 is larger than the half of the first width W1 and larger than the half of the second width W2. Specifically, differences between potentials of the first portion 511 of the third electrode 51 in positions in the second direction D2 and potentials of the first electrode 531 obtained when a potential which is different from that applied to the third electrode 51 is applied to the first electrode 531 and the second electrode 532 is turned off and potentials of the first portion 511 of the third electrode 51 in the positions in the second direction D2 and potentials of the first electrode 531 obtained when a potential which is different from that applied to the third electrode 51 is applied to the first electrode 531 and the second electrode 532 may be suppressed.

The driving circuits 25*a* and 25*b* of this embodiment are also referred to as "driving signal supply circuits". The voltage generation circuit 23 is also referred to as a "holding signal supply circuit".

B. Second Embodiment

In a liquid ejecting head 26*b* of a second embodiment, a shape of a third electrode 51*b* is different from the third electrode 51 of the liquid ejecting head 26 of the first embodiment. Other portions of the liquid ejecting head 26*b* of the second embodiment are the same as those of the liquid ejecting head 26 of the first embodiment.

As described above, according to the first embodiment, although changes of the potential differences ΔVp depending on the number of electrodes turned on may be suppressed, potential differences ΔVp between the portions in the vicinity of the end portions and the portion in the vicinity of the center portion are generated. When potential differences ΔVp are generated, that is, when a voltage drop occurs in a specific position (a position in the vicinity of the center portion as illustrated in FIG. 11), rise of a voltage delays, and therefore, there arises a problem in that an ejection amount is reduced.

Figure 20:
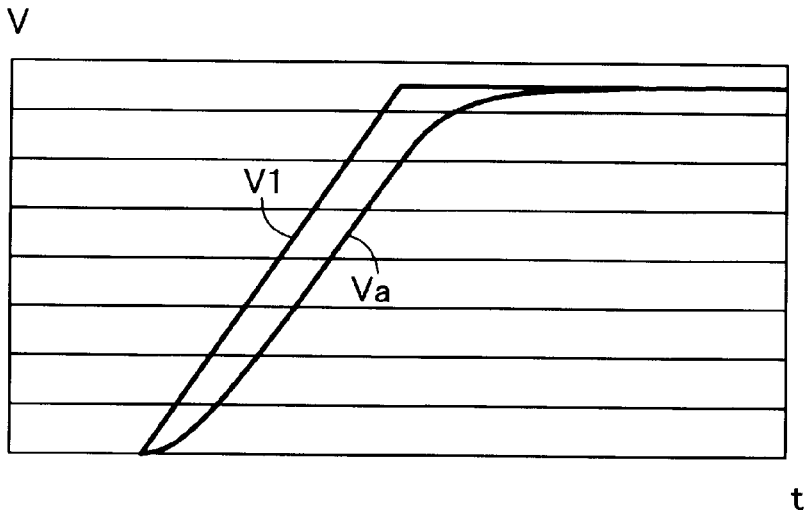
FIG. 20 is a graph of a potential difference between the first portion of the third electrode of the liquid ejecting head of the comparative example and the first electrode in a portion in the vicinity of the center in the X direction.

Hereinafter, detailed description will be made. FIG. 20 is a graph of a potential difference V between the first portion 511 of the third electrode 51CP of the liquid ejecting head 26CP of the comparative example and the first electrode 531 in a portion in the vicinity of the center in the X direction. An axis of abscissae in FIG. 20 denotes time. An axis of ordinates in FIG. 20 represents a potential difference between the first portion 511 of the third electrode 51CP and the first electrode 531 in the portion in the vicinity of the center in the X direction. The graph V1 indicates a potential difference between the first portion 511 of the third electrode 51CP and the first electrode 531 obtained when only the electrode 531 is turned on. The graph Va indicates a potential difference V between the first portion 511 of the third electrode 51CP and the first electrode 531 obtained when all the plurality of discrete electrodes 53 are turned on.

As is apparent from FIG. 20, in the liquid ejecting head 26CP of the comparative example, when only the electrode 531 is turned on, a potential difference V1 between the first portion 511 of the third electrode 51CP and the first electrode 531 ideally changes with time. However, a potential difference Va obtained when all the plurality of discrete electrodes 53 are turned on includes a response delay relative to the ideal time change. Specifically, delay occurs in a voltage rise. As a result, pressure rise in the pressure chambers Ch does not occur. Furthermore, in the potential difference VA obtained when all the plurality of discrete electrodes 53 are turned on, a change of inclination obtained when the potential difference V becomes a steady state is smooth. Consequently, ink droplets ejected by the nozzles Nz and ink included in the nozzles Nz may not be quickly separated from each other, and therefore, an ink amount included in the ink droplets is reduced.

Furthermore, a shift of the potential difference Va from an ideal state when all the plurality of discrete electrodes 53 are turned on varies depending on the positions P2 in the X2 direction (refer to FIGS. 15 and 19), and therefore, ejection of ink droplets may not be performed sufficiently using resonance of the sections of the vibration plate 36 which seals the pressure chambers Ch when the ink droplets are ejected from the pressure chambers Ch.

Furthermore, in the comparative example, as a rate of a size of the pressure chambers Ch in the second direction D2 relative to a size of the pressure chambers Ch in the first direction D1 becomes larger, that is, as a rate of a size of the discrete electrodes 53 in the second direction D2 relative to a size of the discrete electrodes 53 in the first direction D1 becomes larger, crosstalk is more easily generated among the adjacent piezoelectric elements 38.

In the second embodiment, to address the problem described above, a change of the potential difference ΔVp depending on the number of electrodes turned on is suppressed, and in addition, the potential difference ΔVp is reduced.

Figure 21:
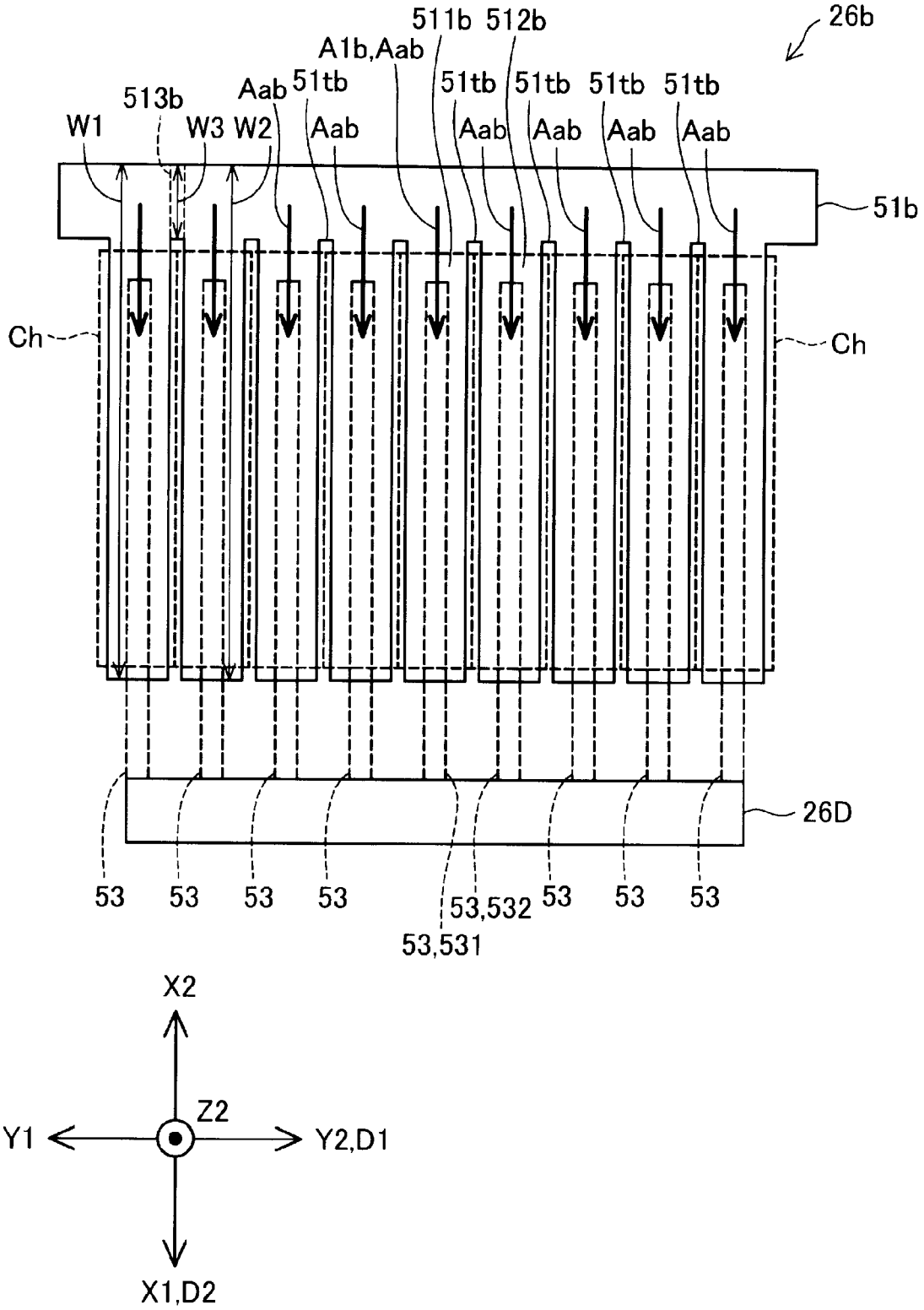
FIG. 21 is a plan view illustrating the discrete electrodes, a common third electrode, and pressure chambers included in the liquid ejecting head according to a second embodiment.

FIG. 21 is a plan view illustrating the discrete electrodes 53, a common third electrode 51*b*, and pressure chambers Ch included in the liquid ejecting head 26*b* according to the second embodiment. Actual sizes and actual shapes of the configurations are not reflected in FIG. 21. In the liquid ejecting head 26 of the first embodiment, the sections of the third electrode 51, including the first portion 511 and the second portion 512, divided by the division sections 51*t* are coupled to each other at ends in the X1 direction and ends in the X2 direction (refer to FIGS. 7 and 8). Then the potential VBS applied by the voltage generation circuit 23 is applied to the sections of the third electrode 51 divided by the division sections 51*t* from both ends in the X direction (refer to the arrow marks A1 of FIG. 7 and the arrow marks Aa of FIG. 8).

However, in the liquid ejecting head 26*b* of the second embodiment, the sections of the third electrode 51 divided by the division sections 51*tb* including the first portion 511*b* and the second portion 512*b* are coupled to each other at ends in the X2 direction and are not coupled to each other at ends in the X1 direction. An end portion of the third portion 513*b* of the third electrode 51*b* in the second direction D2 is positioned on an opposite side of the second direction D2 relative to an end portion of the first portion 511*b* in the second direction D2 and an end portion of the second portion 512*b* in the second direction D2.

A potential VBS is applied by the voltage generation circuit 23 to the sections of the third electrode 51 divided by the division sections 51*t* from the ends in the X2 direction (refer to arrow marks A1*b* and Aab of FIG. 21). Specifically, in the liquid ejecting head 26*b* of the second embodiment, the driving IC 26D is coupled to the electrodes 53 including the first electrode 531 and the second electrode 532 from the second direction D2 side. On the other hand, the voltage generation circuit 23 is coupled to the third electrode 51*b* on a side opposite to the second direction D2.

Figure 22:
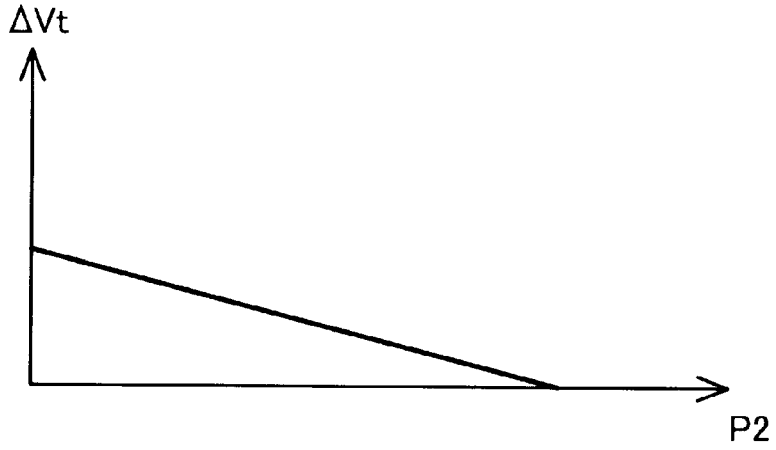
FIG. 22 is a diagram illustrating differences between potentials in the positions in the X2 direction in the first portion of the third electrode of the liquid ejecting head of the second embodiment and potentials in both end portions of the first portion.

FIG. 22 is a diagram illustrating differences ΔVt between potentials in the positions P2 in the X2 direction in the first portion 511 of the third electrode 51*b* of the liquid ejecting head 26*b* of the second embodiment and potentials in both end portions of the first portion 511. Both when only the electrode 531 among the plurality of discrete electrodes 53 included in the liquid ejecting head 26*b* is turned on and when all the plurality of discrete electrodes 53 are turned on, the potential VBS is applied by the voltage generation circuit 23 from ends in the X2 direction to the sections of the third electrode 51 facing the electrodes 53. In FIG. 21, a direction to which a potential is applied when only the electrode 531 is turned on is indicated by an arrow mark A1*b*. In FIG. 21, a direction to which a potential is applied when all the plurality of discrete electrodes 53 are turned on is indicated by arrow marks Aab. Consequently, in the first portion 511 of the third electrode 51, differences ΔVt between the potentials in the positions P2 in the X2 direction in the first portion 511 of the third electrode 51 and potentials in both end portions of the first portion 511 are as illustrated in FIG. 22 due to a resistance of the first portion 511. Specifically, as a portion is farther from an end in the X2 direction, that is, as a portion is closer to an end in the X1 direction, ΔVt is smaller. More specifically, ΔVt is reduced substantially in proportion to a distance between the end portion of the third portion 513*b* in the second direction D2 to the various positions.

Figure 23:
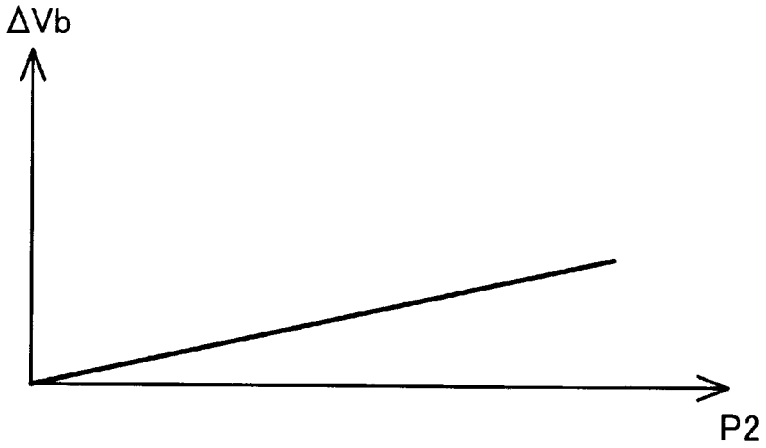
FIG. 23 is a diagram illustrating differences between potentials in the positions in the X2 direction of the first electrode of the liquid ejecting head of the second embodiment and potentials in the end portion of the first electrode on a side coupled to the driving IC.

FIG. 23 is a diagram illustrating differences ΔVb between potentials in the positions P2 in the X2 direction of the first electrode 531 of the liquid ejecting head 26*b* of the second embodiment and potentials in the end portions of the first electrode 531 on a side coupled to the driving IC 26D (refer to a lower portion in FIG. 21). Even in the first electrode 531 of the liquid ejecting head 26*b*, a method for applying a potential Vout to the sections in the first electrode 531 is the same irrespective of whether only the electrode 531 is turned on or whether all the discrete electrodes 53 are turned on. Therefore, potential differences ΔVb relative to potentials in the end portions of the sections of the first electrode 531 are the same as those when only the electrode 531 is turned on.

Specifically, as a portion is farther from an end in the X2 direction, that is, as a portion is closer to an end in the X1 direction, ΔVb is larger. More specifically, ΔVb is increased substantially in proportion to distances between the end portions of the first electrode 531 and the second electrode 532 in the second direction D2 to the various positions.

Figure 24:
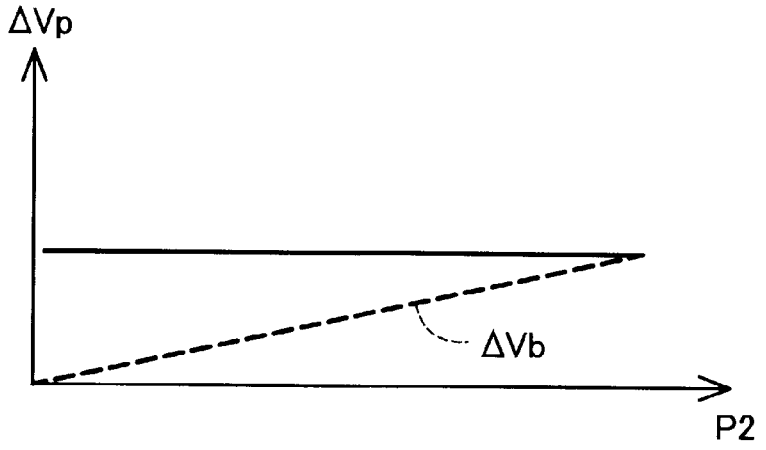
FIG. 24 is a diagram illustrating shifts of potential differences between the first portion of the third electrode of the liquid ejecting head and the first electrode in the positions in the X2 direction relative to a potential difference in the end portion of the first electrode in the X1 direction.

FIG. 24 is a diagram illustrating shifts ΔVp of potential differences between the first portion 511 of the third electrode 51*b* of the liquid ejecting head 26*b* and the first electrode 531 in the positions P2 in the X2 direction relative to a potential difference in the end portion of the first electrode 531 in the X1 direction. The shift ΔVp of the potential differences is obtained by overlapping ΔVt and ΔVb.

According to the second embodiment, in the discrete electrodes 53 including the first electrode 531 and the second electrode 532, a potential of a driving signal shifts from a potential output from the driving IC 26D as a position is closer to an end opposite to the second direction D2 due to a resistance of the electrode (refer to FIG. 22). In the third electrode 51*b*, a potential of a holding signal is more considerably shifted in positons closer to the end in the second direction D2 relative to the potential output from the voltage generation circuit 23 due to a resistance of the third electrode 51*b* (refer to FIG. 23). Therefore, since decreasing tendency of ΔVt and increase tendency of ΔVb cancel each other, a voltage of the third electrode 51*b* of the first electrode 531 and a voltage of the third electrode 51*b* of the second electrode 532 may be closer to a fixed voltage irrespective of a position in the second direction D2 in a piezoelectric body when compared with a state in which the driving IC 26D and the voltage generation circuit 23 are positioned on a side the same as a side of the third electrode 51*b* according to the second embodiment (refer to FIGS. 24 and 11). Consequently, ejection of ink droplets may be performed utilizing resonance of the portions in the vibration plate 36 sealing the pressure chambers Ch when ink droplets are ejected from the pressure chambers Ch.

C. Modifications of Third Electrode

1. First Modification of Third Electrode

Figure 25:
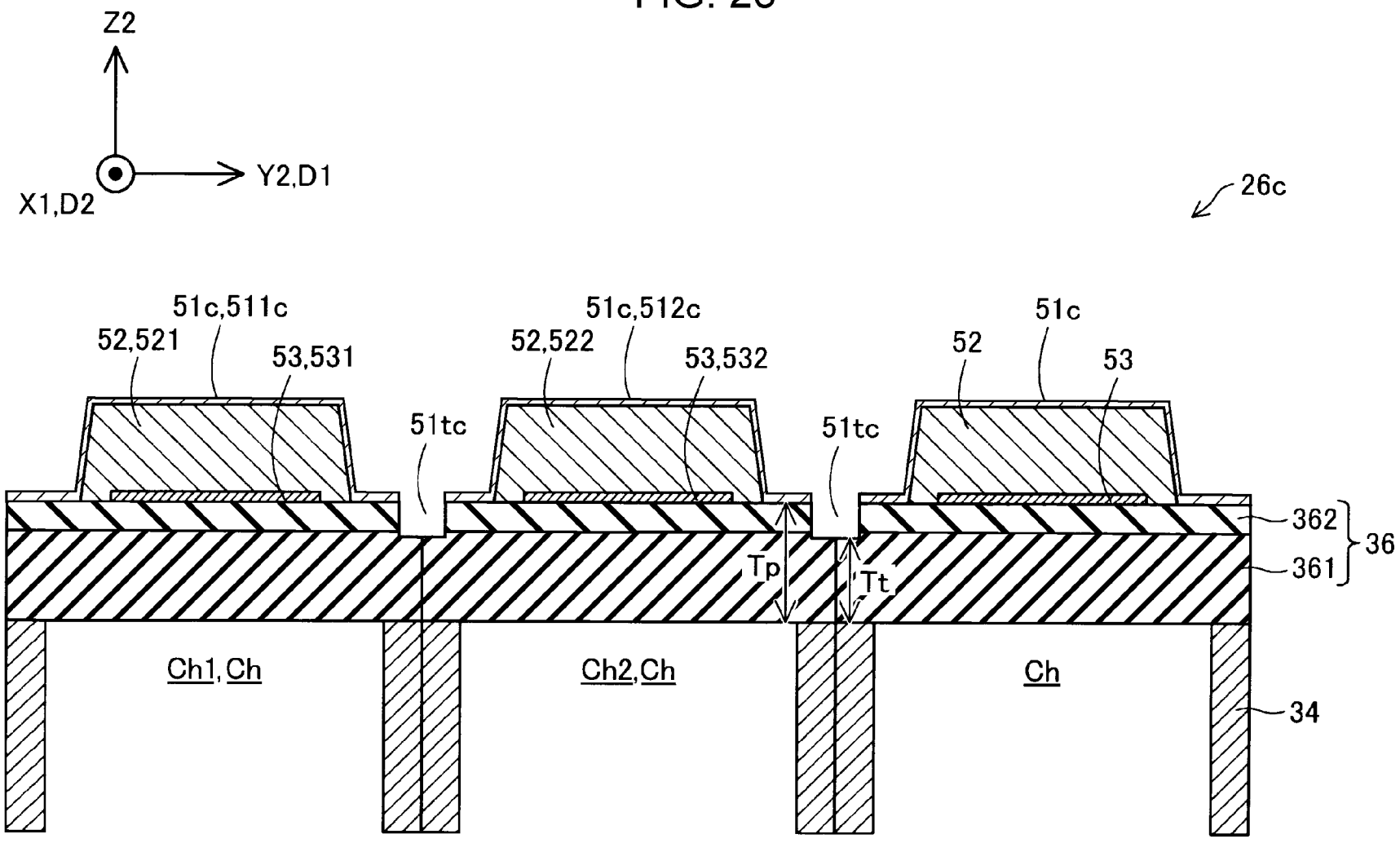
FIG. 25 is a cross sectional view schematically illustrating configurations of a pressure chamber substrate, a vibration plate, and piezoelectric elements according to a first modification of the third electrode.

FIG. 25 is a cross sectional view schematically illustrating configurations of the pressure chamber substrate 34, the vibration plate 36, and the piezoelectric elements 38 according to a first modification of the third electrode. In a liquid ejecting head 26*c* of the first modification of the third electrode, a configuration of division sections 51*tc* is different from the division sections 51*t* of the first embodiment. Other portions of the first modification of the third electrode are the same as those of the first embodiment.

On the vibration plate 36, the third electrode 51 is not disposed in portions of the division sections 51*t* according to the first embodiment. The insulating layer 362 of the vibration plate 36 is disposed also on the division sections 51*t* (refer to FIG. 5). In the first modification of the third electrode, a third electrode 51*c* covers the first piezoelectric body 521, the second piezoelectric body 522, and a portion of a surface of the vibration plate 36 including the first piezoelectric body 521 and the second piezoelectric body 522 disposed thereon. Then the liquid ejecting head 26*c* includes the division sections 51*tc* as recessed portions extending through the third electrode 51*c* to the vibration plate 36. Consequently, the insulating layer 362 of the vibration plate 36 is not disposed in the division sections 51*tc*. The division sections 51*tc* may be formed by performing ion milling after the third electrodes 51*c* are formed on the vibration plate 36 and the piezoelectric body 52, for example. A thickness Tt of portions of the vibration plate 36 on which the division sections 51*tc* are disposed is 70% of a thickness Tp of portions of the vibration plate 36 on which the division sections 51*tc* are not disposed. Also with this configuration, the effects of the first embodiment may be attained.

2. Second Modification of Third Electrode

Figure 26:
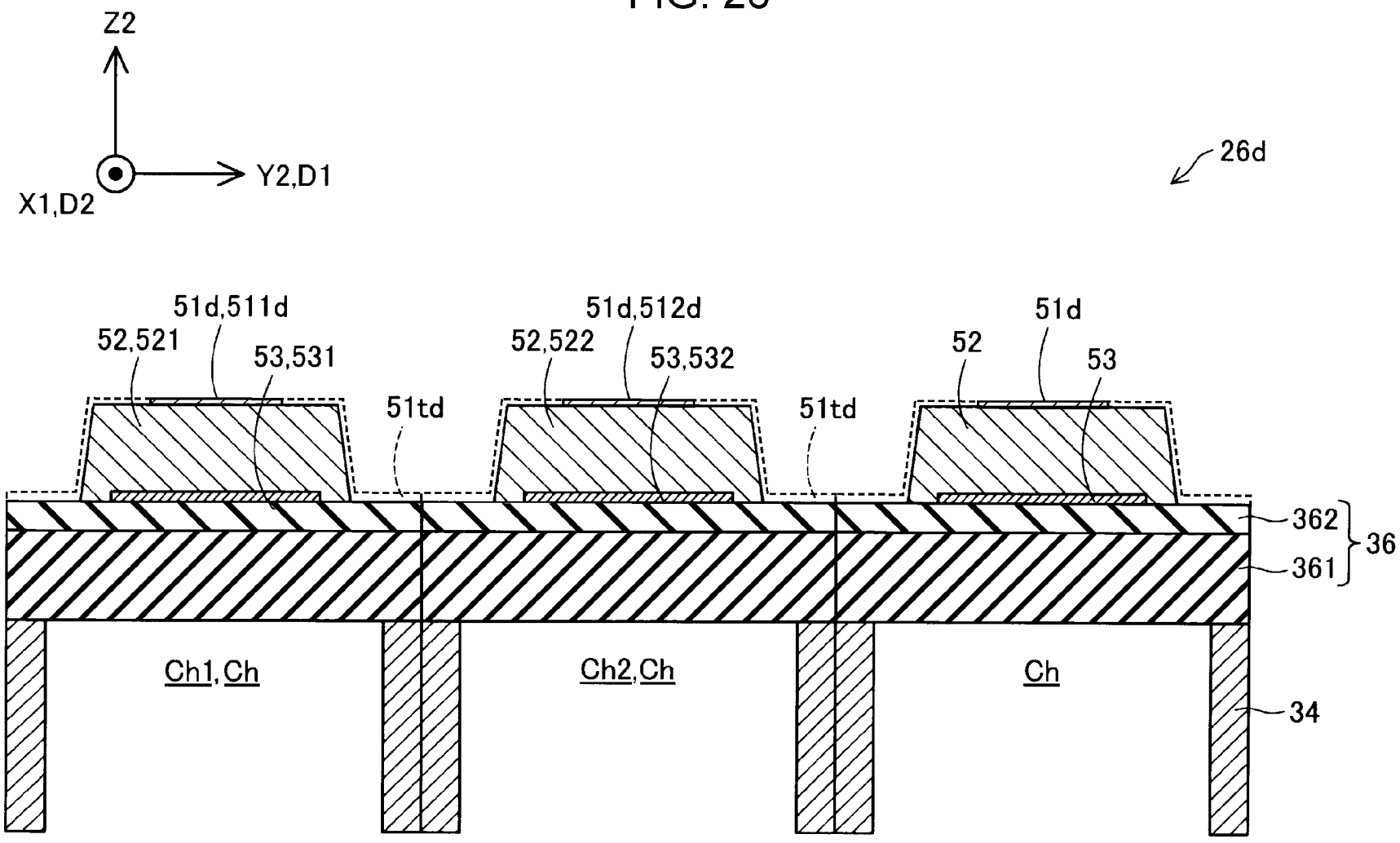
FIG. 26 is a cross sectional view schematically illustrating configurations of a pressure chamber substrate, a vibration plate, and piezoelectric elements according to a second modification of the third electrode.

FIG. 26 is a cross sectional view schematically illustrating configurations of a pressure chamber substrate 34, a vibration plate 36, and piezoelectric elements 38 according to a second modification of the third electrode. In a liquid ejecting head 26*d* of the second modification of the third electrode, a configuration of division sections 51*td* is different from the division sections 51*t* of the first embodiment. Other portions of the second modification of the third electrode are the same as those of the first embodiment.

On the vibration plate 36, the third electrode 51 is not disposed on the division sections 51*t* of the first embodiment (refer to FIG. 5). The fourth portion 514 of the third electrode 51 covers the boundary B1 between the surface of the insulating layer 362 of the vibration plate 36 being in contact with the first piezoelectric body 521 and the first piezoelectric body 521. The fifth portion 515 of the third electrode 51 covers the boundary B2 between the surface of the insulating layer 362 of the vibration plate 36 being in contact with the second piezoelectric body 522 and the second piezoelectric body 522.

According to the second modification of the third electrode, division sections 51*td* are disposed on the vibration plate 36, and further disposed on side surfaces and upper surfaces of the piezoelectric bodies 52. Specifically, according to the second modification of the third electrode, the first portion 511*d* and the second portion 512*d* of the third electrode 51*d* are disposed only on the upper surfaces of the piezoelectric bodies 52. Then a width of the first portion 511*d* in the first direction D1 and a width of the second portion 512*d* in the first direction D1 are smaller than a width of the discrete electrodes 53 in the first direction D1. Also with this configuration, the effects of the first embodiment may be attained.

3. Third Modification of Third Electrode

Figure 27:
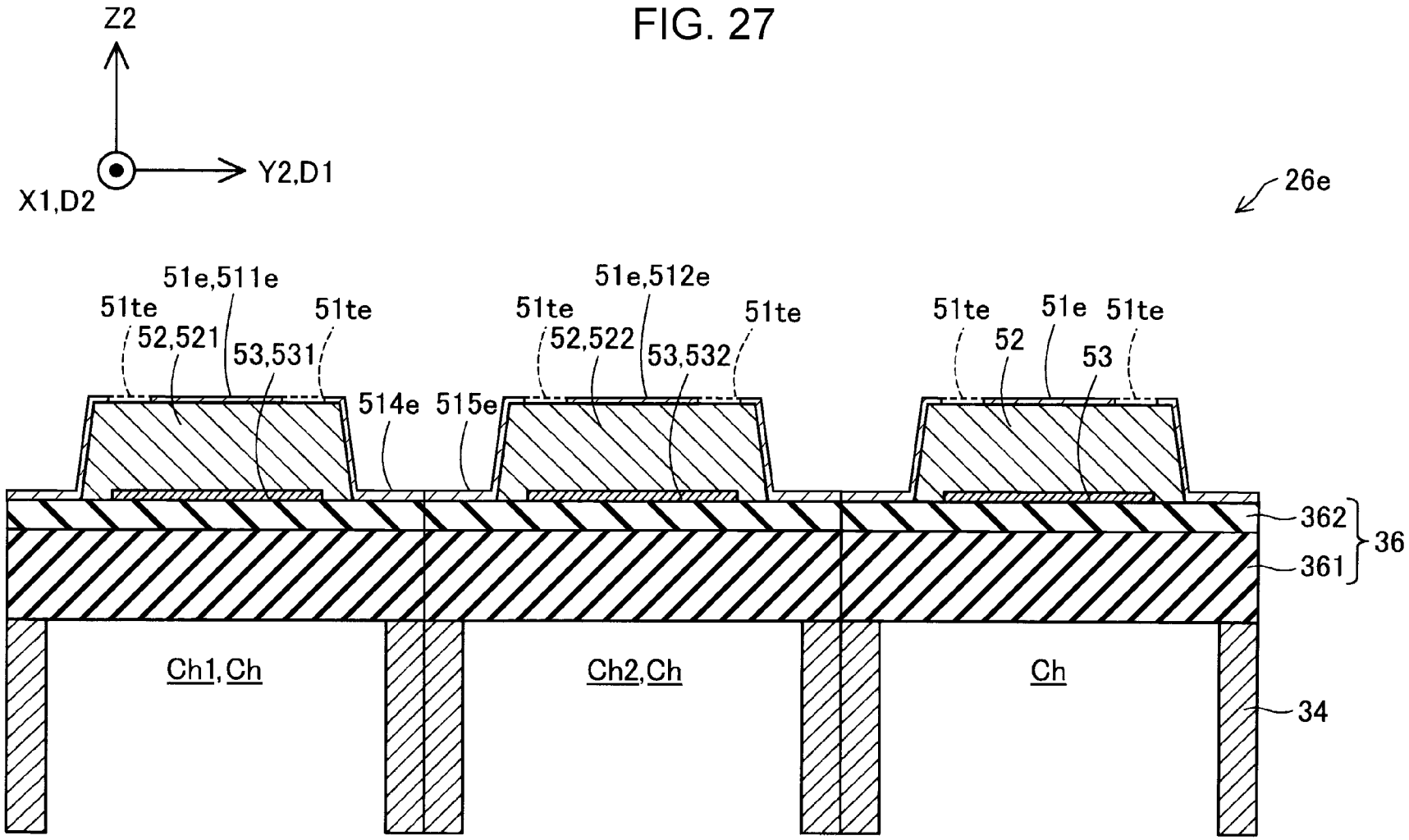
FIG. 27 is a cross sectional view schematically illustrating configurations of a pressure chamber substrate, a vibration plate, and piezoelectric elements according to a third modification of the third electrode.

FIG. 27 is a cross sectional view schematically illustrating configurations of a pressure chamber substrate 34, a vibration plate 36, and piezoelectric elements 38 according to a third modification of the third electrode. In a liquid ejecting head 26*e* of the third modification of the third electrode, a configuration of division sections 51*te* is different from the division sections 51*t* of the first embodiment. Other portions of the third modification of the third electrode are the same as those of the first embodiment.

On the vibration plate 36, the third electrode 51 is not disposed in portions of the division sections 51*t* according to the first embodiment. Then fourth portions 514 and fifth portions 515 of the third electrode 51 are disposed on the vibration plate 36 (refer to FIG. 5). The division sections 51*t* are disposed between the fourth portions 514 and the fifth portions 515.

In the third modification of the third electrode, division sections 51*te* are disposed opposite sides of a first portion 511*e* of a third electrode 51*e* and opposite sides of a second portion 512*e* of the third electrode 51*e* on an upper surface of piezoelectric bodies 52. One of the division sections 51*te* is disposed between the first portion 511*e* and a fourth portion 514*e*. One of the other division sections 51*te* is disposed between the second portion 512*e* and a fifth portion 515*e*. Specifically, two division sections 51*te* are disposed in positions facing one of the discrete electrodes 53 with a corresponding one of the piezoelectric bodies 52 interposed therebetween. With this configuration, the possibility that a portion of the vibration plate 36 is removed when the division sections 51*te* are disposed by a removing process may be reduced. Furthermore, also with this configuration, the effects of the first embodiment may be attained.

4. Fourth Modification of Third Electrode

Figure 28:
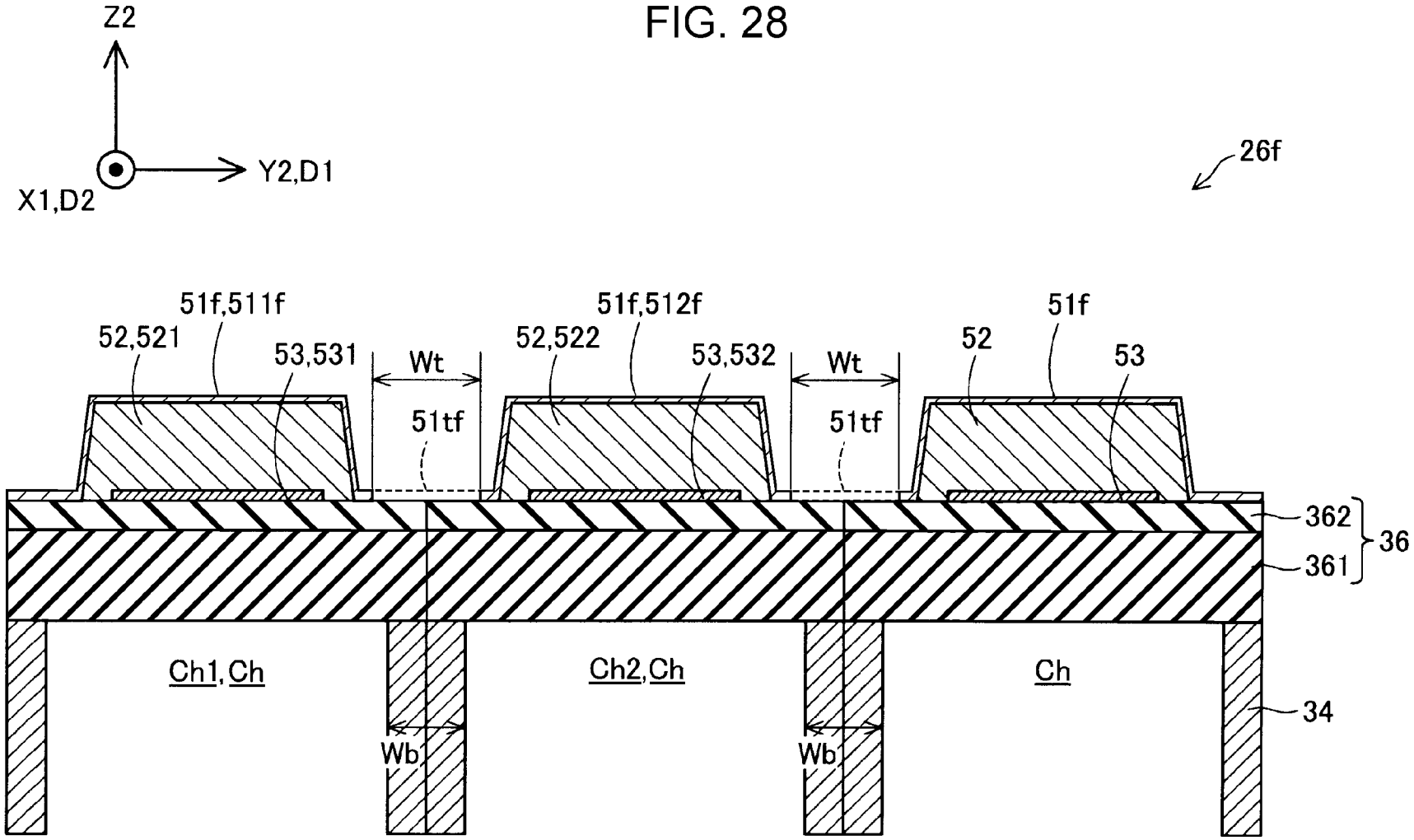
FIG. 28 is a cross sectional view schematically illustrating configurations of a pressure chamber substrate, a vibration plate, and piezoelectric elements according to a fourth modification of the third electrode.

FIG. 28 is a cross sectional view schematically illustrating configurations of a pressure chamber substrate 34, a vibration plate 36, and piezoelectric elements 38 according to a fourth modification of the third electrode. In a liquid ejecting head 26*f* of the fourth modification of the third electrode, a configuration of division sections 51*tf* is different from the division sections 51*t* of the first embodiment. Other portions of the fourth modification of the third electrode are the same as those of the first embodiment.

On the vibration plate 36, the third electrode 51 is not disposed in portions of the division sections 51*t* according to the first embodiment. A width of the division sections 51*t* in the first direction D1 is smaller than a width of a structure defining adjacent pressure chambers Ch in the second direction D2 (refer to FIG. 5).

According to the fourth modification of the third electrode, a width Wt of the third portion 513 in the second direction D2 is larger than a width Wb of a wall portion dividing the pressure chambers Ch including the first pressure chamber Ch1 and the second pressure chamber Ch2 in the second direction D2. The other portions of the fourth modification of the third electrode are the same as those of the first embodiment including configurations of a first portion 511*f*, a second portion 512*f*, a fourth portion 514*f*, and a fifth portion 515*f* of a third electrode 51*f*. Also with this configuration, the effects of the first embodiment may be attained.

D. Other Embodiments

D1. Other Embodiment 1

1. According to the first embodiment, the third electrode 51 includes the first portion 511, the second portion 512, the third portion 513, the fourth portion 514, and the fifth portion 515 (refer to FIG. 5). However, the third electrode 51 may include another configurations between the first portion 511 and the fourth portion 514. The third electrode 51 may include another configurations between the fourth portion 514 and the third portion 513. The third electrode 51 may include another configurations between the second portion 512 and the fifth portion 515. The third electrode 51 may include another configurations between the fifth portion 515 and the third portion 513.

2. According to the first embodiment, the third portion 513 of the third electrode 51 has a certain width in the second direction D2 (refer to FIG. 5). However, the third portion 513 of the third electrode 51 may not have a certain width in the second direction D2. With this configuration, a portion of the third portion 513 having a smallest width in the second direction D2 has the third width W3.

3. According to the first embodiment, the first portion 511 of the third electrode 51 is a portion of the third electrode 51 facing the first electrode 531 with the first piezoelectric body 521 interposed therebetween (refer to FIG. 5). However, the first portion 511 of the third electrode 51 may be extended to a region other than the region facing the first electrode 531, such as side surfaces of the first piezoelectric body 521. With this configuration, the first width may be a width of the third electrode 51 disposed on a side surface of the first piezoelectric body 521 in the second direction D2.

According to the first embodiment, the second portion 512 of the third electrode 51 faces the second electrode 532 with the second piezoelectric body 522 interposed therebetween (refer to FIG. 5). However, the second portion 512 of the third electrode 51 may be extended to a region other than the region facing the second electrode 532, such as side surfaces of the second piezoelectric body 522. With this configuration, the second width may be a width of the third electrode 51 disposed on a side surface of the second piezoelectric body 522 in the second direction D2.

The fourth portion 514 of the third electrode 51 may be disposed on the vibration plate 36 or extended to the side surfaces of the first piezoelectric body 521. The fifth portion 515 of the third electrode 51 may be disposed on the vibration plate 36 or extended to the side surfaces of the second piezoelectric body 522.

4. The technique of the present disclosure is particularly effective to a mode in which a width of discrete electrodes in a first direction is equal to or smaller than ¼ of a length of the discrete electrodes in a second direction, further effective to a mode in which a width of the discrete electrodes is ⅕ of the length of the discrete electrodes in the second direction, and still further effective to a mode in which a width of the discrete electrodes in the first direction is equal to or smaller than 1/10 of the length of the discrete electrodes in the second direction. Note that the width of the discrete electrodes in the first direction is a width of a largest portion of the individual discrete electrodes in the first direction. The length of the discrete electrodes in the second direction is a length of a largest portion of the individual discrete electrodes in the second direction.

In the foregoing embodiment, the second direction orthogonally intersect with the first direction. However, the second direction may be a direction intersecting with the first direction at an angle other than 90 degrees.

D2. Other Embodiment 2

According to the first embodiment, the third electrode 51 includes the first portion 511, the second portion 512, the third portion 513, the fourth portion 514, and the fifth portion 515 (refer to FIG. 5). However, the third electrode 51 may include the first portion 511, the second portion 512, and the third portion 513 but may not include the fourth portion 514 and the fifth portion 515.

D3. Other Embodiment 3

According to the first embodiment, when viewed from the first pressure chamber Ch1, the first electrode 531, the first piezoelectric body 521, and the third electrode 51 are arranged in this order from a portion near the first pressure chamber Ch1 (refer to FIG. 5). When viewed from the second pressure chamber Ch2, the second electrode 532, the second piezoelectric body 522, and the third electrode 51 are disposed in this order from a portion near the second pressure chamber Ch2 (refer to FIG. 5).

However, when viewed from the first pressure chamber Ch1, the third electrode 51, the first piezoelectric body 521, and the first electrode 531 may be disposed in this order from a portion near the first pressure chamber Ch1. Similarly, when viewed from the second pressure chamber Ch2, the third electrode 51, the second piezoelectric body 522, and the second electrode 532 may be disposed in this order from a portion near the second pressure chamber Ch2.

D4. Other Embodiment 4

In the first embodiment, the third electrode 51 covers the first piezoelectric body 521 and further covers the second piezoelectric body 522 (refer to FIG. 5). However, the third electrode may not cover a portion of the piezoelectric body as illustrated in the second and third modifications of the third electrode (refer to FIGS. 26 and 27).

D5. Other Embodiment 5

According to the first embodiment, the third electrode 51 is configured by a single member (refer to FIG. 5). The third electrode 51 may be configured by a plurality of layers in a Z direction using a plurality of materials.

D6. Other Embodiment 6

According to the first embodiment, different driving signals are supplied depending on an ejection amount of ink from the driving IC 26D to the first electrode 531 (refer to a left side of the piezoelectric elements 38 in FIG. 4). Similarly, different driving signals are supplied to the second electrode 532 from the driving IC 26D depending on an ejection amount of ink. However, driving signal supply circuits supplying a driving signal to discrete electrodes may not be disposed for individual discrete electrodes. For example, a driving signal supply circuit supplying a driving signal to the discrete electrodes may be configured by a single integrated circuit (IC). Furthermore, a driving signal supply circuit supplying a driving signal to the discrete electrodes may be configured by a single IC together with a holding signal supply circuit supplying a holding signal having a voltage not changed irrespective of an ejection amount of ink and the other circuits.

D7. Other Embodiment 7

According to the second embodiment, the driving IC 26D is coupled to the electrodes 53 including the first electrode 531 and the second electrode 532 from the second direction D2 side (refer to FIG. 21). On the other hand, the voltage generation circuit 23 is coupled to the third electrode 51*b* in a direction opposite to the second direction D2. However, the driving IC 26D and the voltage generation circuit 23 may be coupled from the same side to the electrodes.

D8. Other Embodiment 8

According to the second embodiment, end portions of the third portion 513*b* of the third electrode 51*b* in the second direction D2 are located in positions on an opposite side of the second direction D2 relative to end portions of the first portion 511*b* in the second direction D2 and end portions of the second portion 512*b* in the second direction D2 (refer to FIG. 21).

However, in a state in which the driving IC 26D is coupled to the electrodes in the second direction D2, the end portions of the third portion of the third electrode in the second direction are positioned in the second direction relative to the end portions of the first portion in the second direction and the end portions of the second portions in the second direction. The liquid ejecting head 26 may have such a mode.

D9. Other Embodiment 9

In the first embodiment, the third width W3 is 1/10 of the first width W1 and the second width W2 (refer to FIG. 5). However, a rate of the third width W3 relative to the first width W1 and the second width W2 may be another value, such as 5%, 15%, 20%, or 25%. Note that the rate of the third width W3 relative to the first width W1 and the second width W2 is preferably smaller than 1/2.

D10. Other Embodiment 10

In the first embodiment, a resistance value of the first portion 511 in the second direction D2 is equal to or larger than 1/20 relative to an inverse number of a maximum current obtained when driving is performed with a voltage gradient of 35 V/1 μsec from a coercive electric field of the first piezoelectric body 521. A resistance value of the second portion 512 in the second direction D2 is equal to or larger than 1/20 relative to an inverse number of a maximum current obtained when driving is performed with a voltage gradient of 35 V/1 μsec from an electric voltage gradient of the second piezoelectric body 522. However, the technique of the present disclosure is effective to other modes.

D11. Other Embodiment 11

The liquid ejecting head 26*c* of the first modification of the third electrode includes the division sections 51*tc* as recessed portions extending through the third electrode 51*c* to the vibration plate 36 (refer to FIG. 25). A thickness Tt of portions of the vibration plate 36 on which the division sections 51*tc* are disposed is 70% of a thickness Tp of portions of the vibration plate 36 on which the division sections 51*tc* are not disposed.

However, a thickness Tt of portions of the vibration plate 36 on which the division sections 51*tc* are disposed may have another rate, such as 50% or 90% of the thickness Tp of the portions of the vibration plate 36 on which the division sections 51*tc* are not disposed. Furthermore, the division sections which are not recessed portions on the vibration plate may be disposed as illustrated in FIG. 5 and FIGS. 26 to 28.

D12. Other Embodiment 12

According to the fourth modification of the third electrode, the width Wt of the third portion 513 in the second direction D2 is larger than the width Wb of the wall portion dividing the pressure chambers Ch including the first pressure chamber Ch1 and the second pressure chamber Ch2 in the second direction D2 (refer to FIG. 28). However, according to the first modification of the third electrode, a width of the third portion 513 in the second direction D2 may be smaller than a width of a wall portion dividing the pressure chambers Ch including the first pressure chamber Ch1 and the second pressure chamber Ch2 in the second direction D2 (refer to FIG. 25).

D13. Other Embodiment 13

In the foregoing embodiment, the liquid ejecting apparatus 100 including the liquid ejecting head 26 and the controller 21 controlling an ejection operation of the liquid ejecting head 26 is described. However, the technique of the present disclosure is not limited to this and may be realized as a liquid ejecting apparatus which does not include a controller and which receives a control signal through a network.

E. Further Embodiments

The present disclosure is not limited to the embodiments described above and may be realized in various modes without departing from the scope of the present disclosure. For example, the present disclosure may be realized by the following modes. The technical features of the foregoing embodiments corresponding to technical features of embodiments described below may be replaced or combined where appropriate to address a portion of or all the problems of the present disclosure or attain a portion of or all the effects of the present disclosure. When the technical features are not described as requirements in the specification, the technical features may be deleted where appropriate.

1. According to an embodiment of the present disclosure, a liquid ejecting head ejecting liquid is provided. A liquid ejecting head ejecting liquid includes a first piezoelectric body, a second piezoelectric body arranged in a position different from the first piezoelectric body in a first direction, a first electrode configured to be electrically coupled to the first piezoelectric body and not to be electrically coupled to the second piezoelectric body, a second electrode configured to be electrically coupled to the second piezoelectric body and not to be electrically coupled to the first piezoelectric body, and a third electrode configured to be electrically coupled to both the first piezoelectric body and the second piezoelectric body. A width in a second direction of the first portion disposed in a position corresponding to the first piezoelectric body in the third electrode which intersects with the first direction is a first width. A width in a second direction of the second portion in the third electrode disposed in a position corresponding to the second piezoelectric body is a second width. A width in the second direction of the third portion in the third electrode disposed in a position between the first piezoelectric body and the second piezoelectric body in the first direction is a third width which is smaller than the first width and the second width.

With this configuration, a width of the third portion of the third electrode disposed between the first piezoelectric body and the second piezoelectric body has a width in the second direction smaller than those of the first and second portions. Therefore, when a potential different from that applied to the first and third electrodes are applied and the second electrode is turned off, a potential of the first portion of the third electrode is not assigned in the first direction but assigned in the second direction. Furthermore, even when potentials which are different from that applied to the third electrode are applied to the first and second electrodes, a potential of the first portion of the third electrode is not assigned in the first direction but assigned in the second direction. Accordingly, differences between potentials of the first portion of the third electrode in positions in the second direction and potentials of the first electrode obtained when a potential which is different from that applied to the third electrode is applied to the first electrode and the second electrode is turned off and potentials of the first portion of the third electrode in the positions in the second direction and potentials of the first electrode obtained when a potential which is different from that applied to the third electrode is applied to the first electrode and the second electrode may be suppressed.

Accordingly, differences between potentials of the second portion of the third electrode in positions in the second direction and potentials of the second electrode obtained when a potential which is different from that applied to the third electrode is applied to the second electrode and the second electrode is turned off and potentials of the second portion of the third electrode in the positions in the second direction and potentials of the second electrode obtained when a potential which is different from that applied to the third electrode is applied to the first electrode and the second electrode may be suppressed.

2. In the liquid ejecting head of the foregoing embodiment, a width in the second direction of a fourth portion disposed between the first piezoelectric body and the second piezoelectric body in the first direction and near the first piezoelectric body in the first direction relative to the third portion in the third electrode may be a fourth width which is larger than the third width, and a width in the second direction of a fifth portion disposed between the first piezoelectric body and the second piezoelectric body in the first direction and near the second piezoelectric body in the first direction relative to the third portion in the third electrode may be a fifth width which is larger than the third width.

3. The liquid ejecting head of the foregoing embodiment may further include a pressure chamber substrate including a first pressure chamber in which pressure is applied to liquid by distortion of the first piezoelectric body and a second pressure chamber accommodating liquid in which pressure is applied to liquid by distortion of the second piezoelectric body. The first electrode, the first piezoelectric body, and the third electrode may be disposed in this order from a portion near the first pressure chamber when viewed from the first pressure chamber. The second electrode, the second piezoelectric body, and the third electrode may be disposed in this order from a portion near the second pressure chamber when viewed from the second pressure chamber.

4. In the liquid ejecting head of the foregoing embodiment, the third electrode may cover the first piezoelectric body and cover the second piezoelectric body.

5. In the liquid ejecting head of the foregoing embodiment, the third electrode may be configured by a single member.

6. The liquid ejecting head of the foregoing embodiment may further include a driving signal supply circuit configured to supply different driving signals depending on an ejection amount of liquid to the first electrode and supply different driving signals depending on an ejection amount of liquid to the second electrode, and a holding signal supply circuit configured to supply a holding signal having an unchanged voltage irrespective of the ejection amount of ink to the third electrode.

7. In the liquid ejecting head of the foregoing embodiment, the driving signal supply circuit may be coupled to the first electrode and the second electrode from one side in the second direction, and the holding signal supply circuit may be coupled to the third electrode on the other side in the second direction.

8. In the liquid ejecting head of the foregoing embodiment, an end portion on the one side of the third portion of the third electrode is positioned near the other side relative to the end portion on the one side of the first portion, and near the other side relative to the end portion on the one side of the second portion.

9. In the liquid ejecting head of the foregoing embodiment, the third width may be smaller than half of the first width and smaller than half of the second width.

10. In the liquid ejecting head of the foregoing embodiment, a resistance value of the first portion in the second direction may be equal to or larger than 1/20 relative to an inverse number of a maximum current obtained when driving is performed with a voltage gradient of 35 V/1 μsec from a coercive electric field of the first piezoelectric body. A resistance value of the second portion in the second direction may be equal to or larger than 1/20 relative to an inverse number of a maximum current obtained when driving is performed with a voltage gradient of 35 V1 μsec from a coercive electric field of the second piezoelectric body.

11. In the liquid ejecting head of the foregoing embodiment, the first piezoelectric body and the second piezoelectric body may be disposed on a vibration plate deformed by distortion of the first piezoelectric body and distortion of the second piezoelectric body. The third electrode may cover the first piezoelectric body, the second piezoelectric body, and a portion of a surface of the vibration plate on which the first piezoelectric body and the second piezoelectric body are disposed. The liquid ejecting head may include recessed portions extending through the third electrodes to the vibration plate, and a thickness of portions in the vibration plate where the recessed portions are disposed may be equal to or larger than half of a thickness of a portion which does not include the recessed portions on the vibration plate.

12. The liquid ejecting head of the foregoing embodiment further includes a pressure chamber substrate including a first pressure chamber in which pressure is applied to liquid by distortion of the first piezoelectric body and a second pressure chamber accommodating liquid in which pressure is applied to liquid by distortion of the second piezoelectric body. A width of the third portion in the second direction may be larger than a width of a structure defining the first pressure chamber and the second pressure chamber in the second direction.

13. According to another aspect of the present disclosure, a liquid ejecting apparatus includes the liquid ejecting head according to the foregoing embodiment and a controller configured to control an ejection operation of the liquid ejecting head.

The plurality of components included in the embodiments of the present disclosure may not be requirements. Some of the components may be modified, deleted, and replaced by other new components, and a portion of limited content of the components may be partially removed where appropriate to address some or all the problems described above or to attain some of or all the effects described in this specification. Furthermore, to address some of or all the problems described above or to attain some of or all the effects described in this specification, some of or all the technical features included in an embodiment of the present disclosure described above may be combined with some of or all the technical features included in the other embodiments of the present disclosure as an independent embodiment of the present disclosure.

What is claimed is:

1. A liquid ejecting head ejecting liquid, comprising:

a first piezoelectric body;

a second piezoelectric body arranged in a position different from the first piezoelectric body in a first direction;

a first electrode configured to be electrically coupled to the first piezoelectric body and not to be electrically coupled to the second piezoelectric body;

a second electrode configured to be electrically coupled to the second piezoelectric body and not to be electrically coupled to the first piezoelectric body; and a third electrode configured to be electrically coupled to both the first piezoelectric body and the second piezoelectric body, wherein a width in a second direction of a first portion disposed in a position corresponding to the first piezoelectric body in the third electrode which intersects with the first direction is a first width, wherein a width in the second direction of a second portion in the third electrode disposed in a position corresponding to the second piezoelectric body is a second width, and wherein a width in the second direction of a third portion in the third electrode disposed in a position between the first piezoelectric body and the second piezoelectric body in the first direction is a third width which is smaller than the first width and the second width, wherein a width in the second direction of a fourth portion disposed between the first piezoelectric body and the second piezoelectric body in the first direction and near the first piezoelectric body in the first direction relative to the third portion in the third electrode is a fourth width which is larger than the third width, and wherein a width in the second direction of a fifth portion disposed between the first piezoelectric body and the second piezoelectric body in the first direction and near the second piezoelectric body in the first direction relative to the third portion in the third electrode is a fifth width which is larger than the third width.

2. The liquid ejecting head according to claim 1, further comprising:

a pressure chamber substrate including a first pressure chamber in which pressure is applied to liquid by distortion of the first piezoelectric body and a second pressure chamber accommodating liquid in which pressure is applied to liquid by distortion of the second piezoelectric body, wherein the first electrode, the first piezoelectric body, and the third electrode are disposed in this order from a portion near the first pressure chamber when viewed from the first pressure chamber, and wherein the second electrode, the second piezoelectric body, and the third electrode are disposed in this order from a portion near the second pressure chamber when viewed from the second pressure chamber.

3. The liquid ejecting head according to claim 2, wherein the third electrode covers the first piezoelectric body and covers the second piezoelectric body.

4. The liquid ejecting head according to claim 1, wherein the third electrode is configured by a single member.

5. The liquid ejecting head according to claim 1, further comprising:

a driving signal supply circuit configured to supply different driving signals depending on an ejection amount of liquid to the first electrode and supply different driving signals depending on an ejection amount of liquid to the second electrode, and a holding signal supply circuit configured to supply a holding signal having an unchanged voltage irrespective of the ejection amount of ink to the third electrode.

6. The liquid ejecting head according to claim 5, wherein the driving signal supply circuit is coupled to the first electrode and the second electrode from one side in the second direction, and wherein the holding signal supply circuit is coupled to the third electrode on the other side in the second direction.

7. The liquid ejecting head according to claim 6, wherein an end portion on the one side of the third portion of the third electrode is positioned near the other side relative to the end portion on the one side of the first portion, and near the other side relative to the end portion on the one side of the second portion.

8. The liquid ejecting head according to claim 1, wherein the third width is smaller than half of the first width and smaller than half of the second width.

9. The liquid ejecting head according to claim 1, wherein a resistance value of the first portion in the second direction is equal to or larger than 1/20 relative to an inverse number of a maximum current obtained when driving is performed with a voltage gradient of 35 V/1 μsec from a coercive electric field of the first piezoelectric body, and wherein a resistance value of the second portion in the second direction is equal to or larger than 1/20 relative to an inverse number of a maximum current obtained when driving is performed with a voltage gradient of 35 V1 μsec from a coercive electric field of the second piezoelectric body.

10. The liquid ejecting head according to claim 1, wherein the first piezoelectric body and the second piezoelectric body are disposed on a vibration plate deformed by distortion of the first piezoelectric body and distortion of the second piezoelectric body, wherein the third electrode covers the first piezoelectric body, the second piezoelectric body, and a portion of a surface of the vibration plate on which the first piezoelectric body and the second piezoelectric body are disposed, and wherein the liquid ejecting head includes recessed portions extending through the third electrodes to the vibration plate, and a thickness of portions in the vibration plate where the recessed portions are disposed is equal to or larger than half of a thickness of a portion which does not include the recessed portions on the vibration plate.

11. A liquid ejecting apparatus comprising:

the liquid ejecting head set forth in claim 1; and a controller configured to control an ejection operation of the liquid ejecting head.

12. A liquid ejecting head ejecting liquid, comprising:

a first piezoelectric body;

a second piezoelectric body arranged in a position different from the first piezoelectric body in a first direction;

a first electrode configured to be electrically coupled to the first piezoelectric body and not to be electrically coupled to the second piezoelectric body;

a second electrode configured to be electrically coupled to the second piezoelectric body and not to be electrically coupled to the first piezoelectric body;

a third electrode configured to be electrically coupled to both the first piezoelectric body and the second piezoelectric body; and a pressure chamber substrate including a first pressure chamber in which pressure is applied to liquid by distortion of the first piezoelectric body and a second pressure chamber accommodating liquid in which pressure is applied to liquid by distortion of the second piezoelectric body, wherein a width in a second direction of a first portion disposed in a position corresponding to the first piezoelectric body in the third electrode which intersects with the first direction is a first width, wherein a width in the second direction of a second portion in the third electrode disposed in a position corresponding to the second piezoelectric body is a second width, wherein a width in the second direction of a third portion in the third electrode disposed in a position between the first piezoelectric body and the second piezoelectric body in the first direction is a third width which is smaller than the first width and the second width, and wherein a width of the third portion in the second direction is larger than a width of a structure dividing the first pressure chamber and the second pressure chamber in the second direction.

* * * * *